US009128413B2

(12) United States Patent
Mitsui et al.

(10) Patent No.: US 9,128,413 B2
(45) Date of Patent: Sep. 8, 2015

(54) DEVELOPING DEVICE, AND IMAGE FORMING APPARATUS USING THE SAME

(71) Applicant: FUJI XEROX CO., LTD., Tokyo (JP)

(72) Inventors: Shinji Mitsui, Kanagawa (JP); Munenobu Okubo, Kanagawa (JP); Yasuyuki Tsutsumi, Kanagawa (JP); Kazuaki Iikura, Kanagawa (JP); Yosuke Ninomiya, Kanagawa (JP); Yoshifumi Ozaki, Kanagawa (JP); Akihiko Noda, Kanagawa (JP); Hirokazu Hamano, Kanagawa (JP); Takafumi Wakai, Kanagawa (JP); Masaru Sakuma, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 93 days.

(21) Appl. No.: 13/888,902

(22) Filed: May 7, 2013

(65) Prior Publication Data

US 2014/0147144 A1 May 29, 2014

(30) Foreign Application Priority Data

Nov. 27, 2012 (JP) ..... 2012-259179

(51) Int. Cl.
*G03G 15/06* (2006.01)
*G03G 15/08* (2006.01)

(52) U.S. Cl.
CPC ..... *G03G 15/0877* (2013.01)

(58) Field of Classification Search
USPC ..... 399/53, 119, 120, 258–260
See application file for complete search history.

(56) References Cited

U.S. PATENT DOCUMENTS

2010/0226682 A1* 9/2010 Tanaka et al. ..... 399/106
2011/0194864 A1* 8/2011 Nakatake et al. ..... 399/27

FOREIGN PATENT DOCUMENTS

JP A-61-159675 7/1986
JP A-2009-025493 2/2009

* cited by examiner

*Primary Examiner* — Walter L Lindsay, Jr.
*Assistant Examiner* — Jessica L Eley
(74) *Attorney, Agent, or Firm* — Oliff PLC

(57) ABSTRACT

A developing device includes a toner holding member that is rotatably installed opposite to an image holding member which holds a latent image and circularly moves, a supply member that has a rough surface capable of capturing toner, a toner supply portion that supplies new toner, and a restriction member that restricts an amount of toner used for development, wherein the toner supply portion connects an accommodation chamber to a developing chamber via a toner transport path, wherein a developing chamber side opening is located on a lower side of an accommodation chamber side opening of the toner transport path, and wherein a width size in a direction following a rotation direction of the supply member in the developing chamber side opening of the toner transport path is set to be smaller than an outer diameter of the supply member in a projection plane viewed from the supply member side.

16 Claims, 17 Drawing Sheets

DEVELOPING DEVICE, AND IMAGE FORMING APPARATUS USING THE SAME

CROSS-REFERENCE TO RELATED APPLICATIONS

This application is based on and claims priority under 35 USC 119 from Japanese Patent Application No. 2012-259179 filed Nov. 27, 2012.

BACKGROUND (i) Technical Field

The present invention relates to a developing device, and an image forming apparatus using the same.

(ii) Related Art

SUMMARY

According to an aspect of the invention, there is provided a developing device including a toner holding member that is rotatably installed opposite to an image holding member which holds a latent image and circularly moves, and holds and transports nonmagnetic mono-component toner to a developing region opposite to the image holding member so as to develop the latent image on the image holding member, a supply member that has a rough surface capable of capturing toner on a peripheral surface of an elastically deformable elastic body, comes into elastic contact with the toner holding member so as to be rotatably installed, and supplies toner to the toner holding member in a contact region with the toner holding member, a toner supply portion that faces a replenishment region at a location separate from the contact region with the toner holding member in the supply member and supplies new toner, and a restriction member that is installed further toward a downstream side in a rotation direction than the contact region with the supply member and further toward an upstream side in the rotation direction than the developing region of the toner holding member, friction-charges toner held in the toner holding member, and restricts an amount of toner used for development, wherein the toner supply portion connects an accommodation chamber which accommodates new toner so as to be replenished to a developing chamber in which the supply member and the toner holding member are disposed, via a toner transport path, wherein a developing chamber side opening of the toner transport path is located on a lower side of an accommodation chamber side opening of the toner transport path and is disposed so as to face the supply member, and wherein a width size in a direction following a rotation direction of the supply member in the developing chamber side opening of the toner transport path is set to be smaller than an outer diameter of the supply member in a projection plane viewed from the supply member side.

BRIEF DESCRIPTION OF THE DRAWINGS

Exemplary embodiments of the present invention will be described in detail based on the following figures, wherein.

DETAILED DESCRIPTION

Outline of Exemplary Embodiments

Figure 1A:
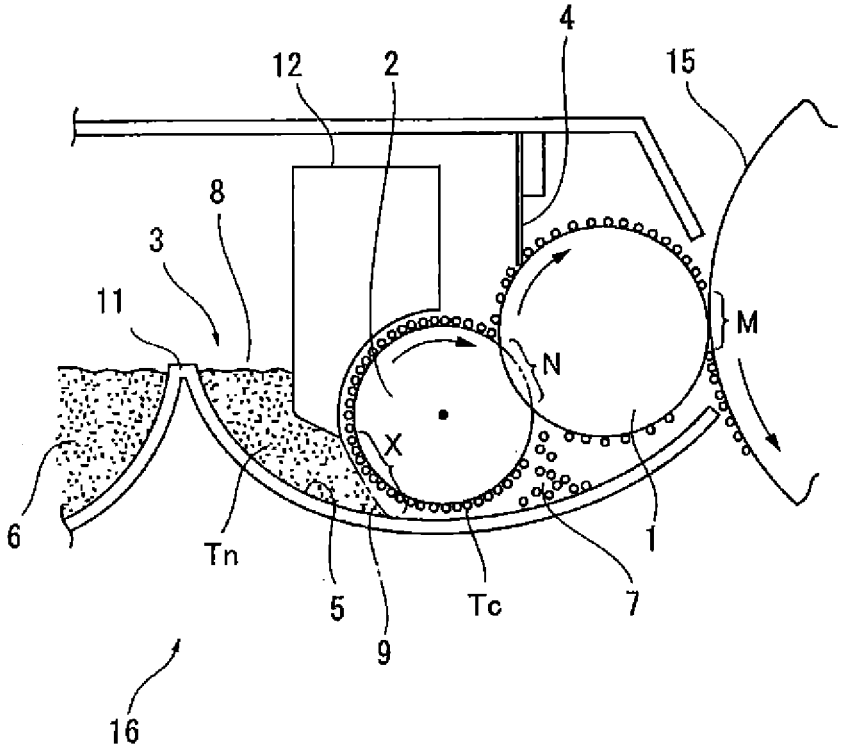
FIG. 1A is a diagram illustrating an outline of exemplary embodiments of an image forming apparatus including a developing device to which the invention is applied.

FIG. 1A is a diagram illustrating an outline of exemplary embodiments of an image forming apparatus including a developing device to which the invention is applied.

In the same figure, the image forming apparatus includes an image holding member 15 which holds a latent image and is moved in a circulation manner, and a developing device 16 which is disposed opposite to the image holding member 15 and develops the latent image on the image holding member 15.

Figure 1B:
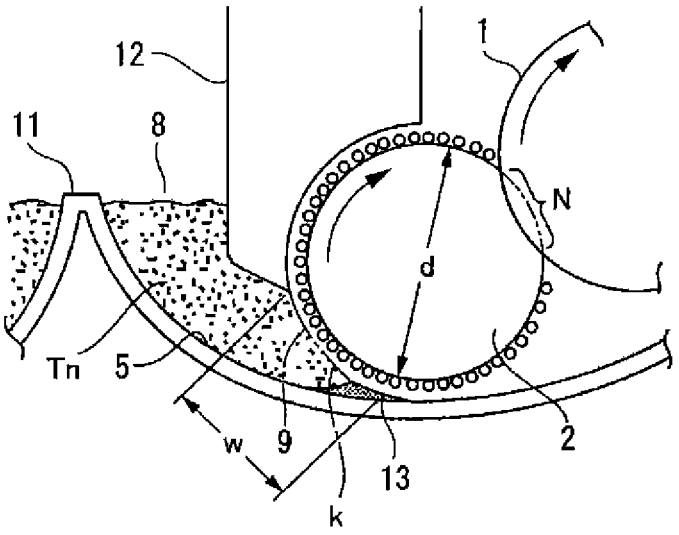
FIG. 1B is a diagram illustrating a main portion thereof.

In addition, the developing device 16 used in the present exemplary embodiment, as shown in FIGS. 1A and 1B, includes a toner holding member 1 which is provided so as to be rotatable opposite to the image holding member 15 which holds a latent image and is moved in a circulation manner, and holds and transports nonmagnetic toner to a developing region M facing the image holding member 15 so as to develop the latent image on the image holding member 15; a supply member 2 which has a rough surface capable of capturing toner on a peripheral surface of an elastic body which can be elastically deformed, comes into elastic contact with the toner holding member 1, is provided so as to be rotatable, and supplies toner to the toner holding member 1 in a contact region N with the image forming apparatus 1; a toner replenishment portion 3 which faces a replenishment region X separate from the contact region N with the toner holding member 1 in the supply member 2 and replenishes new toner Tn; and a restriction member 4 which is provided in the toner holding member 1 further toward the downstream side in the rotation direction than the contact region N with the supply member 2 and further toward the upstream side in the rotation direction than the developing region M of the toner holding member 1, friction-charges the toner held in the toner holding member 1, and restricts an amount of toner used for development. The toner replenishment portion 3 connects an accommodation chamber 6 which accommodates new toner Tn so as to be replenished to a developing chamber 7 in which the supply member 2 and the toner holding member 1 are disposed, via a toner transport path 5. A developing chamber side opening 9 of the toner transport path 5 is located on a lower side than an accommodation chamber side opening 8 of the toner transport path 5. In addition, a width size w of the toner transport path 5 which is disposed so as to face the supply member 2 in a direction following the rotation direction of the supply member 2 in the developing chamber side opening 9 is set to be smaller than an outer diameter d of the supply member 2 in a projection plane viewed from the supply member 2 side.

In this technical means, the toner holding member 1 may be appropriately selected as long as it holds toner and provides the toner to the developing region M with the image holding member 15.

In addition, the supply member 2 may rotate in an opposite direction in a location facing the toner holding member 1 or may rotate in the same direction. Here, in a case of rotating in the same direction, it is necessary for both of the two to have a speed difference in order to supply toner from the supply member 2 to the toner holding member 1. Further, the supply member 2 may have a rough surface (concaves and convexes) for capturing toner on the peripheral surface, may be a foam body as a representative aspect, and have, for example, recesses such as grooves formed on a peripheral surface of an elastic rubber or the like. In addition, the foam body may use open cells or closed cells, but the open cells are appropriate from the viewpoint of softness or costs.

Furthermore, the toner replenishment portion 3 may be appropriately selected as long as it replenishes new toner Tn to the predefined replenishment region X of the supply member 2.

Here, the reason why the replenishment region X by the toner replenishment portion 3 is set to a location separate from the contact region N between the supply member 2 and the toner holding member 1 is that old and new toner are positively prevented from being mixed on the supply member 2 when the new toner Tn is directly supplied to the contact region N between the supply member 2 and the toner holding member 1 by the toner replenishment portion 3.

In addition, the restriction member 4 may representatively use a plate-shaped member which extends so as to face in the rotation direction of the toner holding member 1 and elastically comes into contact therewith as long as it friction-charges toner held in the toner holding member 1 and restricts a toner amount to a predefined amount, but the restriction member 4 is not limited thereto, and a rotation body may be appropriately selected. Since toner captured in the supply member 2 is friction-charged by the restriction member 4, if new toner Tn and old toner Tc with different electrification characteristics are mixed, an electric charge amount between the old and new toners considerably varies, and an electric charge distribution becomes spread. In relation to this, in circumstances in which most of toner captured in the supply member 2 is old toner Tc, the electrification characteristics thereof are substantially the same, and thus there is no concern that an electric charge amount varies or an electric charge distribution becomes spread.

Further, the toner replenishment portion 3 is limited to an aspect of having the toner transport path 5 with a predetermined structure. However, if the following conditions are satisfied, a shape of the toner transport path 5 may appropriately select a linear shape, a bending shape, a curved shape, or the like.

Here, the fact that "the developing chamber side opening 9 of the toner transport path 5 is located on the lower side than the accommodation chamber side opening 8" is a requirement for the new toner Tn staying at the toner transport path 5 by its own weight.

In addition, an operation caused by the facts that "the toner transport path 5 is disposed so as to face the supply member 2" and "the width size w of the developing chamber side opening 9 of the toner transport path 5 is smaller than the outer diameter d of the supply member 2 in a projection plane viewed from the supply member 2 side" is as follows.

That is, since the staying new toner Tn presses the peripheral surface of the supply member 2 by its own weight so as to form an interface (a kind of wall), for example, in a case where peeled toner which is peeled off in the contact region N between the toner holding member 1 and the supply member 2 is attached to the supply member 2 and is re-transported, the peeled toner moves along a staying part interface k of the new toner Tn without being mixed in the staying part of the new toner Tn. For this reason, the old toner Tc attached to the supply member 2 is re-transported preferentially to the new toner Tn by the supply member 2 so as to be used for development.

In addition, since the new toner Tn in the toner transport path 5 is dammed up by the supply member 2, the new toner Tn in the toner transport path 5 rarely directly enters the developing chamber 7 from the rim of the developing chamber side opening 9. Particularly, if an aspect is used in which the edge of the developing chamber side opening 9 of the toner transport path 5 is disposed so as to be as close to the supply member 2 as possible, this is preferable in that the new toner Tn in the toner transport path 5 is further suppressed from entering the developing chamber 7.

Further, if the preferentially re-transported toner is used for development in the developing region M of the image holding member 15, an amount (corresponding to an amount of re-transported toner) of toner attached to the periphery of the supply member 2 decreases, and a depression is formed in a location in which the re-transported toner decreases in the peripheral surface of the supply member 2. When this location faces and passes the developing chamber side opening 9 of the toner transport path 5, the new toner Tn is naturally replenished from the staying part of the new toner Tn to the depression of the peripheral surface of the supply member 2.

Next, a representative aspect or a preferable aspect of the developing device 16 will be described.

First, as a preferable aspect of the developing chamber side opening 9 of the toner transport path 5, there may be an aspect in which the developing chamber side opening 9 of the toner transport path 5 is disposed further toward the downstream side in the rotation direction of the supply member 2 than the lowest position of the supply member 2 and further toward the upstream side in the supply member 2 than the uppermost position of the supply member 2.

Here, if the developing chamber side opening 9 of the toner transport path 5 is disposed further toward the upstream side in the rotation direction of the supply member 2 than the lowest position of the supply member 2, the old toner Tc which is peeled off in the contact region N between the supply member 2 and the toner holding member 1 is easily directly mixed the new toner Tn from the developing chamber side opening 9 of the toner transport path 5. In addition, if the developing chamber side opening 9 of the toner transport path 5 is disposed further toward the downstream side in the rotation region of the supply member 2 than the uppermost position of the supply member 2, there is concern that the new toner Tn transported from the toner transport path 5 may be easily mixed in the contact region N between the supply member 2 and the toner holding member 1. Therefore, this aspect is aimed at preventing these mixture factors.

However, in an aspect in which a unit for attaching peeled toner to the supply member 2 is added, or an aspect in which a structure for sealing a gap between the edge of the developing chamber side opening 9 of the toner transport path 5 and the supply member 2 is added, a mixture factor of old and new toners is prevented, and thus the developing chamber side opening 9 may be disposed at locations other than in this aspect.

In addition, as a representative aspect of the toner transport path 5, there may be an aspect in which a gap with the accommodation chamber 6 is divided by a first partition member 11, and a gap with the developing chamber 7 is divided by a second partition member 12, and thereby the toner transport path 5 is formed between both the partition members 11 and 12.

In this aspect, a height of the first partition member 11 is adjusted or an occupation volume of the second partition member 12 is adjusted, and thereby it is possible to restrict an amount of the new toner Tn staying at the toner transport path 5.

In addition, a volume of the developing chamber 7 around the supply member 2 or the toner holding member 1 may be restricted with respect to the first and second partition members 11 and 12.

Further, as a preferable aspect of a member forming the developing chamber side opening 9 of the toner transport path 5, there may be an aspect in which a downstream side opposite member which is opposite to at least the supply member 2 and is located on the downstream side in the rotation direction of the supply member 2 is disposed in a noncontact manner with the supply member 2 via a gap which can restrict a toner layer which is required to be captured in the peripheral surface of the supply member 2.

Here, since the downstream side opposite member is disposed in a noncontact manner with the supply member 2 via a gap which can restrict a toner layer which is required to be captured in the peripheral surface of the supply member 2, the new toner Tn is in a location adjacent to the developing chamber side opening 9 of the toner transport path 5; however, in circumstances in which the old toner Tc is captured in the peripheral surface of the supply member 2, some of the new toner Tn is attached to a surface of the old toner Tc layer of the supply member 2 and is transported in a case of passing through a region corresponding to the developing chamber side opening 9 of the toner transport path 5. However, in a region corresponding to the downstream side opposite member, the new toner Tn attached to the surface of the old toner Tc of the supply member 2 is restricted by an opposite surface to the supply member 2 of the downstream side opposite member before passing through the downstream side opposite member, and thus does not pass through the downstream side opposite member.

When toner is used for development in the developing region M of the image holding member 15, an amount of re-transported old toner Tc around the supply member 2 is reduced, and a depression is formed in a location where the re-transported toner decreases in the peripheral surface of the supply member 2. When this location faces and passes the developing chamber side opening 9 of the toner transport path 5, the new toner Tn is replenished to the region where the re-transported toner decreases in the peripheral surface of the supply member 2, and passes through the region corresponding to the downstream side opposite member.

In addition, in an aspect in which toner is replenished using a staying type toner transport path 5 from the transverse direction, the developing chamber side opening 9 of the toner transport path 5 has a toner pile portion 13 (refer to FIG. 1B) in which old and new toners are piled according to use with the time on its lower edge, and the toner pile portion 13 provides an aspect in which the new toner Tn is dammed up from moving to the developing chamber 7 other than the supply member 2 in the toner transport path 5.

In the aspect in which toner is replenished using the staying type toner transport path 5 from the transverse direction, the toner pile portion 13 piled through repetitive meeting of old and new toners according to use with the time is formed on its lower edge of the developing chamber side opening 9 of the toner transport path 5, but this toner pile portion 13 functions as a damning portion (dam) which dams up the new toner Tn in the toner transport path 5.

For this reason, even if the lower edge position of the developing chamber side opening 9 of the toner transport path 5 is set to be separate from the supply member 2, it is possible to effectively prevent the new toner Tn from directly entering the developing chamber 7 in the toner transport path 5 or conversely the old toner Tc captured in the supply member 2 from entering the toner transport path 5 due to the presence of the toner pile portion 13.

Further, as a peripheral structure of the developing chamber side opening 9 of the toner transport path 5, the edge of the developing chamber side opening 9 of the toner transport path 5 may be disposed so as to be sealed in a contact manner with the peripheral surface of the supply member 2 via an elastic body (not shown).

In this aspect, since the edge of the developing chamber side opening 9 of the toner transport path 5 is disposed so as to be sealed in a contact manner with the peripheral surface of the supply member 2 via the elastic body, the gap between the toner transport path 5 and the peripheral surface of the supply member 2 is sealed with the elastic body. For this reason, there is little concern that the new toner Tn staying inside the toner transport path 5 is mixed with the old toner Tc of the developing chamber 7. Here, when an elastic modulus and an amount of the elastic body on which the supply member 2 encroaches are appropriately adjusted, a situation in which re-transported toner captured in the peripheral surface of the supply member 2 is scraped out when coming into contact with the elastic body is effectively prevented.

In addition, in this aspect, the developing chamber side opening 9 of the toner transport path 5 may be disposed opposite to the peripheral surface of the upper half of the supply member 2.

As described above, in the aspect in which the developing chamber side opening 9 of the toner transport path 5 is disposed opposite to the peripheral surface of the upper half of the supply member 2, there is concern that the new toner Tn in the toner transport path 5 may move to the contact region N between the supply member 2 and the toner holding member 1 if a gap is formed between the developing chamber side opening 9 and the supply member 2; however, this aspect is preferable in that the movement of the new toner Tn is hindered by the elastic body.

In addition, as a preferable aspect of the image forming apparatus including this kind of developing device 16, there may an aspect in which a controller (not shown) capable of controlling consumption of toner is added.

This kind of controller may include, for example, a calculation unit which calculates a toner amount consumed in a predefined number of image formations, a discrimination unit which discriminates whether or not a toner amount calculated in the calculation unit is equal to or more than a predefined threshold value, an ejection unit which ejects toner in the developing device 16 to the image holding member 15 side by a predefined amount when the toner amount discriminated in the discrimination unit is less than the threshold value, and a cleaning unit which cleans off the toner on the image holding member 15, ejected from the ejection unit.

This aspect is intended to stabilize developing quality by grasping and removing deteriorating toner in advance in light of the toner easily deteriorating since the old toner Tc is not consumed and remains on the supply member 2 when an amount of consumed toner is small.

Here, as a representative aspect of the calculation unit of an amount of consumed toner, there may be a method of calculating an amount of consumed toner on the basis of an image density. As the number of image formations, an appropriate selection may be performed such as counting the number of recording materials to be output which is converted into a reference size, or counting a driving time of the developing device 16. In addition, the threshold value used for discrimination may be obtained in advance through tests, for example, as a limit value (allowable lower limit value) which does not cause poor developing. Further, the ejection unit regards toner captured in the supply member 2 as deteriorating when a condition arrives in which there is a high probability of reaching poor developing, and may force the toner to be ejected from the developing device 16. As a representative operation, the ejection unit forms a latent image for ejection on the image holding member 15, and ejects the toner in a form of developing the latent image. In addition, an image formed in an ejection operation is not particularly limited, and may be a solid image or other images. In addition, a different image may be used to be suitable for an amount of consumed toner. However, it is necessary to eject much toner due to a case where an amount of consumed toner is small. In addition, as the cleaning unit, an aspect of using a cleaning unit on the image holding member 15 side is generally employed, but the invention is not limited thereto, and an output to a recording material may be performed, or other cleaning components may be provided separately.

Hereinafter, the invention will be described more in detail based on exemplary embodiments shown in the accompanying drawings.

Exemplary Embodiment 1

Overall configuration of image forming apparatus

Figure 2:
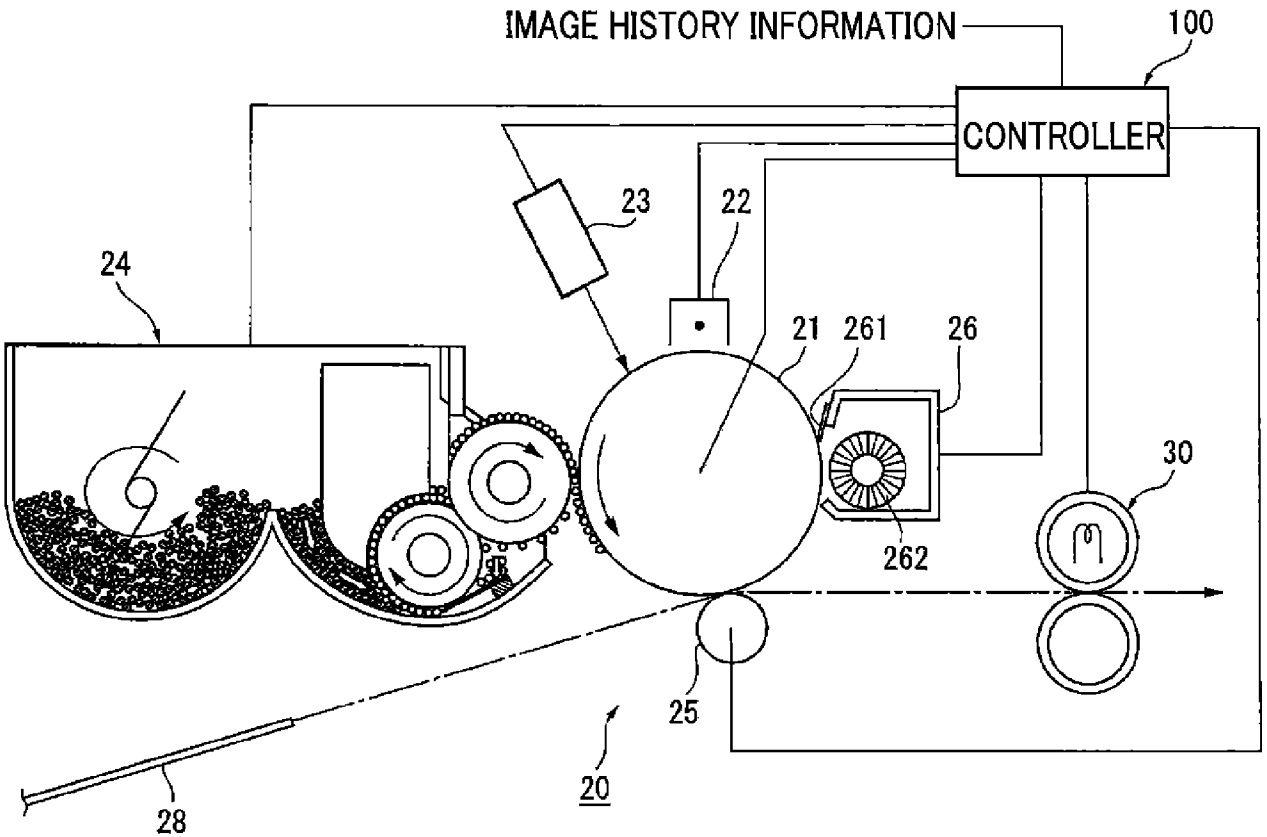
FIG. 2 is a diagram illustrating an overall configuration of an image forming apparatus according to Exemplary Embodiment 1.

FIG. 2 is a diagram illustrating an overall configuration of an image forming apparatus according to Exemplary Embodiment 1.

In FIG. 2, the image forming apparatus 20 includes a photoconductor 21 which is an image holding member and has a drum shape, a charging device 22 which charges the photoconductor 21, an exposure device 23 which writes a latent image in the photoconductor 21 charged by the charging device 22 with light, a developing device 24 which generates of a visible image of the latent image written in the photoconductor 21 with a developer (toner), a transfer device 25 which transfers a toner image which is generated as the visible image by the developing device 24 onto a recording material 28 which is a transfer medium, and a cleaning device 26 which cleans off remaining toner which remains on the photoconductor 21 after the transfer is performed in the transfer device 25.

In this example, the transfer image transferred to the recording material 28 is fixed in a fixing device 30 and is then discharged. In addition, the reference numeral 100 indicates a controller which controls each constituent element of the image forming apparatus 20. Further, in this example, a transfer medium exemplifies the recording material 28 but is not limited thereto, and includes an intermediate transfer body which temporarily holds a toner image before being transmitted to the recording material 28.

Here, the photoconductor 21 includes a photoconductive layer formed on a frame made of metal with a drum shape.

In addition, it is shown that the charging device 22 has, for example, a charging vessel, and a discharging wire is disposed as a charging member in the charging vessel, but the charging device 22 is not limited thereto, and an appropriate selection may be performed such as, for example, using a roll-shaped charging member.

Further, as the exposure device 23, a laser scanning device, an LED array, or the like is used.

In addition, the developing device 24 employs a monocomponent development method using nonmagnetic toner. Details of the developing device 24 will be described later.

Further, as the transfer device 25, a transfer device which applies a transfer electric field for electrostatically transferring a toner image on the photoconductor 21 to the recording material 28 side may be used, and, for example, a roll-shaped transfer member to which a transfer voltage is applied is used, but the transfer device is not limited thereto and may appropriately select a transfer corotron using a discharging wire, or the like.

In addition, it is shown that the cleaning device 26 is opened toward the photoconductor 21 side, and has a cleaning vessel accommodating remaining toner, a plate-shape cleaning member 261 such as a blade or a scraper which is disposed on the downstream side edge in the rotation direction of the photoconductor 21 in the opening of the cleaning vessel, and a rotating cleaning member 262 with a brush shape or a roll shape which is disposed on the upstream side of the plate-shaped cleaning member 261 in the rotation direction of the photoconductor 21, but the cleaning device 26 is not limited thereto, and an appropriate selection may be performed.

In addition, all or some of the photoconductor 21, the charging device 22, the developing device 24, and the cleaning device 26 may be assembled in advance as a process cartridge which is an image forming assembly and may be installed in a receptacle which is provided in an image forming apparatus casing in advance so as to be attachable thereto and detachable therefrom.

Basic Configuration of Developing Device

In this example, as shown in FIGS. 2 to 5, the developing device 24 includes a developing vessel 40 which accommodates nonmagnetic toner T and is opened so as to face the photoconductor 21, a developing roller 41 disposed at a location adjacent to the opening of the developing vessel 40, a supply roller 42 which is disposed on the rear side of the developing roller 41 and can supply the nonmagnetic toner T in the developing vessel 40 to the developing roller 41, a charging blade 45 which is disposed further toward the downstream side in the toner transport direction than the location where the toner is supplied by the supply roller 42 in the developing roller 41, and a toner replenishment mechanism 60 which is provided on the rear side of the supply roller 42 and can replenish the nonmagnetic new toner Tn to the supply roller 42.

In addition, one end of a sealing member (not shown) which is formed of an elastic member is fixed to the lower edge of the opening of the developing vessel 40, and a free end of the sealing member is disposed so as to come into elastic contact with the developing roller 41, thereby closing a gap between the developing roller 41 and the developing vessel 40.

Developing Roller and Supply Roller

In this example, the developing roller 41 rotates in the same direction as the photoconductor 21 at the location facing the photoconductor 21, and includes a roller main body layer 41*b* which is made of a resin or a rubber with predefined volume resistivity and is formed around a shaft body 41*a* made of metal, and a surface of the roller main body layer 41*b* has a surface roughness to an extent that toner can be transported.

In addition, the supply roller 42 rotates in an opposite direction to the developing roller 41 at the location facing the developing roller 41, and includes an elastic layer 42*b* which can be elastically deformed, has predefined volume resistivity, and is formed around a shaft body 42*a* made of metal. The elastic layer 42*b* is formed of a foam body such as, for example, urethane foam sponge rubber, and the surface thereof is a rough surface 42*c* (refer to FIG. 5) to an extent that toner can be sufficiently captured.

In this example, since the elastic layer 42*b* of the supply roller 42 is sufficiently smoother than the roller main body layer 41*b* of the developing roller 41, the developing roller and the supply roller 42 are disposed such that the developing roller 41 encroaches on the elastic layer 42*b* side of the supply roller 42 at a predefined encroaching amount. With this disposition, a contact region N (a nip region) is formed between both of the two, and, in this example, in the contact region N between the developing roller 41 and the supply roller 42, the supply roller 42 rotates downward from the top, and the developing roller 41 rotates upward from the bottom.

For this reason, the supply roller 42 performs an operation of peeling off transported toner on the developing roller 41 and supplying toner on the supply roller 42 side to the developing roller 41 in the contact region N with the developing roller 41. In addition, the developing roller 41 holds the nonmagnetic toner T supplied from the supply roller 42, transports to the developing region M facing the photoconductor 21, and uses for development in the developing region M.

Charging Blade

The charging blade 45 is formed of a metal plate such as, for example, phosphor bronze, has one end fixed to the opening edge of the developing vessel 40, extends so as to protrude in a direction opposite to the rotation direction of the developing roller 41, and is disposed so as to come into pressing contact with the surface of the developing roller 41 with a predetermined pushing pressure. For this reason, the toner T held in the developing roller 41 passes through the pressing contact location between the charging blade 45 and the developing roller 41 and is thus friction-charged and restricted to a predetermined transport amount. In addition, the charging blade 45 is fixed to the opening edge of the developing vessel 40 via a bracket 46.

Developing Vessel

The developing vessel 40 has a developing chamber 51 in which the developing roller 41 and the supply roller 42 are disposed, and an accommodation chamber 52 accommodating the new toner Tn which can be replenished to the developing chamber 51 at a location adjacent to the developing chamber 51.

In this example, in the developing vessel 40, a block-shaped partition member 53 which partitions the developing chamber 51 and the accommodation chamber 52 is installed so as to be separate from the bottom wall of the developing vessel 40. The bottom wall of the developing vessel 40 is integrally formed as double curved parts 40*a* and 40*b* so as to overhang downward, and a mountain-shaped partition portion 54 is formed at a boundary location between the curved parts 40*a* and 40*b*.

Toner Replenishment Mechanism

In this example, in the toner replenishment mechanism 60, the new toner Tn is accommodated in the accommodation chamber 52 of the developing vessel 40, the accommodation chamber 52 is connected to the developing chamber 51 via a toner transport path 61, and an agitator 62 which agitates and transports the new toner Tn to the developing chamber 51 side via the toner transport path 61 is disposed in the accommodation chamber 52 as a agitation and transport member.

In addition, the curved part 40*b* corresponding to the accommodation chamber 52 in the bottom wall of the developing vessel 40 is formed so as to be curved at a curvature following a trajectory of a rotating free end of the agitator 62.

Toner Transport Path

In this example, the toner transport path 61 is formed between the partition member 53 and one curved part 40*b* which is a part of the bottom wall of the developing vessel 40.

Figure 5:
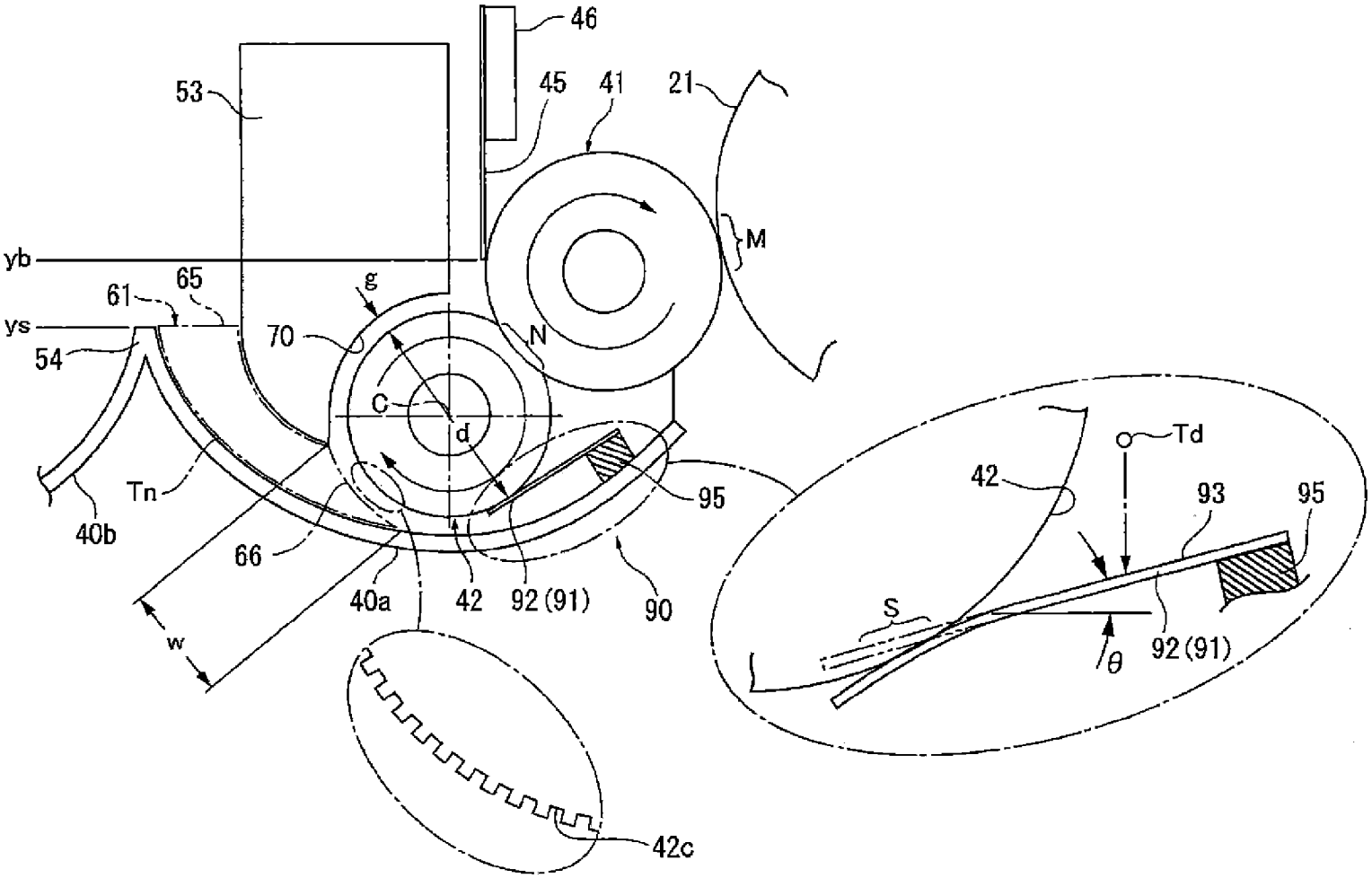
FIG. 5 is a diagram illustrating details of the main portion of the developing device shown in FIG. 4.

Here, as shown in FIG. 5, an accommodation chamber side opening 65 is located further toward the upper side than a developing chamber side opening 66, and the toner transport path 61 is formed in a curved shape along the curved part 40*a* from the accommodation chamber 52 to the developing chamber 51.

In addition, the developing chamber side opening 66 of the toner transport path 61 is disposed so as to face the supply roller 42, and forms a replenishment region X in which the new toner Tn is replenished to the developing chamber 51.

Particularly, in this example, the developing chamber side opening 66 of the toner transport path 61 is formed at a location (in this example, a location separate therefrom by about a semicircle) separate from the contact region N between the developing roller 41 and the supply roller 42, and is provided on a lower side of a central position C of the supply roller 42, and a width size w in a direction following the rotation direction of the supply roller 42 in the developing chamber side opening 66 is set be smaller than an outer diameter d of the supply roller 42 in a projection plane viewed from the supply roller 42 side.

In addition, in this example, since the new toner Tn in the accommodation chamber 52 is transported to the toner transport path 61 by the agitator 62, as indicated by the dot chain line in FIG. 5, the new toner Tn fills the toner transport path 61 in a state of staying thereat by its own weight and presses the supply roller 92 via the developing chamber side opening 66.

Partition Portion and Partition Member

In addition, the accommodation chamber side opening 65 of the toner transport path 61 is provided at a position ys corresponding to the top of the partition portion 54 which is integrally formed with a part of the bottom wall of the developing vessel 40, and may be set on a lower side of a contact position yb with the developing roller 41 in the charging blade 45. When this dimension relationship is set, even if the new toner Tn fills the toner transport path 61 in a state of staying thereat, there is no concern that the toner inside the developing chamber 51 is pushed up to the contact position yb with the developing roller 41 in the charging blade 45 due to pressing by the staying part of the new toner Tn, and it is possible to effectively prevent a pressing contact of the charging blade 45 with the developing roller 41 from varying due to filling of the toner at the position of the charging blade 45 of the developing chamber 51.

Further, in this example, a curved restriction surface 70, which is formed along the peripheral surface of the supply roller 42 with a gap g so as to face the supply roller 42, is formed at a location adjacent to the developing chamber side opening 66 of the toner transport path 61 in the partition member 53. Here, the gap g may be appropriately selected as long as it is selected to an extent that a toner layer to be captured in the supply roller 42 can be restricted, and may be set as a gap of an extent which satisfies the maximum consumption amount of toner per unit time in the developing device 24. In this example, the gap is selected in a range of 0.5 mm to 1.0 mm. In this case, as the lower limit value (0.5 mm), a size is selected which is required to maintain a noncontact state with the supply roller 42 in consideration of an installation allowance when installing the partition member 53 in the developing vessel 40, and, as the upper limited value (1.0 mm), a size is selected which is required to restrict a toner layer to be captured in the supply roller 42.

Power Source for Forming Electric Field

In this example, a developing power source 81 forming a developing electric field with the photoconductor 21 is provided in the developing roller 41, and a supply power source 82 for forming a supply electric field which is used to supply the nonmagnetic toner T to the developing roller 41 is provided in the supply roller 42.

Here, the developing power source 81 may apply a developing voltage in which an AC component is superimposed on a predefined DC component to the developing roller 41, and the supply power source 82 may apply a supply voltage which has a DC component of a predefined potential difference (including "0") with respect to the DC component of the developing power source 81 and in which an AC component with the same cycle as the AC component of the developing power source 81 is superimposed on the DC component.

However, in a case where supply of toner is secured in the contact region N between both of the two even if a supply electric field is not applied between the developing roller 41 and the supply roller 42, a method of sharing the developing power source 81 as the supply power source 82 may be employed, and a potential difference between both of the two may be set to be about 0.

Attachment Mechanism

Particularly, in the present exemplary embodiment, an attachment mechanism 90 is provided on the lower side of the contact region N between the developing roller 41 and the supply roller 42 and attaches toner peeled off from the developing roller 41 and the supply roller 42 to the supply roller 42 in the developing chamber 51 of the developing vessel 40.

In this example, the attachment mechanism 90, as shown in FIG. 5, has a guide member 91 which catches peeled toner Td peeled off when passing through the contact region N and guides the caught peeled toner Td toward the supply roller 42 side. The peripheral surface of the supply roller 42 comes into pressing contact with a part of the guide member 91, and thereby the peeled toner Td caught by the guide member 91 is moved to the supply roller 42 side and is thus attached to the peripheral surface of the supply roller 42.

In this example, the guide member 91 is formed by an elastic sheet 92 which can be elastically deformed, one end of the elastic sheet 92 is fixed to an attached member 95 provided at a part of the bottom wall of the developing vessel 40, and the elastic sheet 92 is disposed so as to be tilted to an extent of an angle θ with respect to the horizon such that the pressing contact location S of the supply roller 42 is located on the lower side of the catching location of the peeled toner Td in the elastic sheet 92.

As this kind of elastic sheet 92, for example, a thermoplastic polyurethane sheet, a polyimide sheet, a polyester sheet, a PET sheet, or the like is used. In addition, in relation to the tilt angle θ of the elastic sheet 92, a value (for example, 10°) required for the peeled toner Td to roll and move is selected as a lower limit value. On the other hand, if the tilt angle θ excessively increases, it is expected that a volume of the location catching the peeled toner Td is reduced, and thus an upper limit value is selected in a range (for example, 45°) which does not cause poor peeling from the supply roller 42 due to an increase in pressure of the toner in the catching location.

Particularly, in this example, the surface (corresponding to the surface of the portion catching the peeled toner Td) of the elastic sheet 92 may have a smoothing surface 93 on which the caught peeled toner Td can roll and move toward the supply roller 42 side. Here, the smoothing surface 93 described here is related to, for example, an arithmetic mean roughness Rz, and may satisfy $Rz \leq 0.6$ μm.

In addition, in this example, the pressing contact location S of the elastic sheet 92 is around the front end of the elastic sheet 92, and a contact force of the elastic sheet 92 with the supply roller 42 is set to be smaller than a contact force in the contact region N between the developing roller 41 and the supply roller 42. Specifically, when an elastic deformation amount during processing contact with the supply roller 42 relative to an upright state in which the elastic sheet 92 is not elastically deformed is defined as an encroachment amount, a contact force is calculated by the elastic modulus and the encroachment amount of the elastic sheet 92, and thereby a contact force of the elastic sheet 92 may be appropriately selected.

Further, in this example, the pressing contact location S of the elastic sheet 92 is displaced further toward the contact region N side than the lowest part of the supply roller 42, and, for this reason, a contact force gradually increases toward the front end side of the elastic sheet 92 in the pressing contact location S of the elastic sheet 92.

Basic Operation by Developing Device

Figure 3:
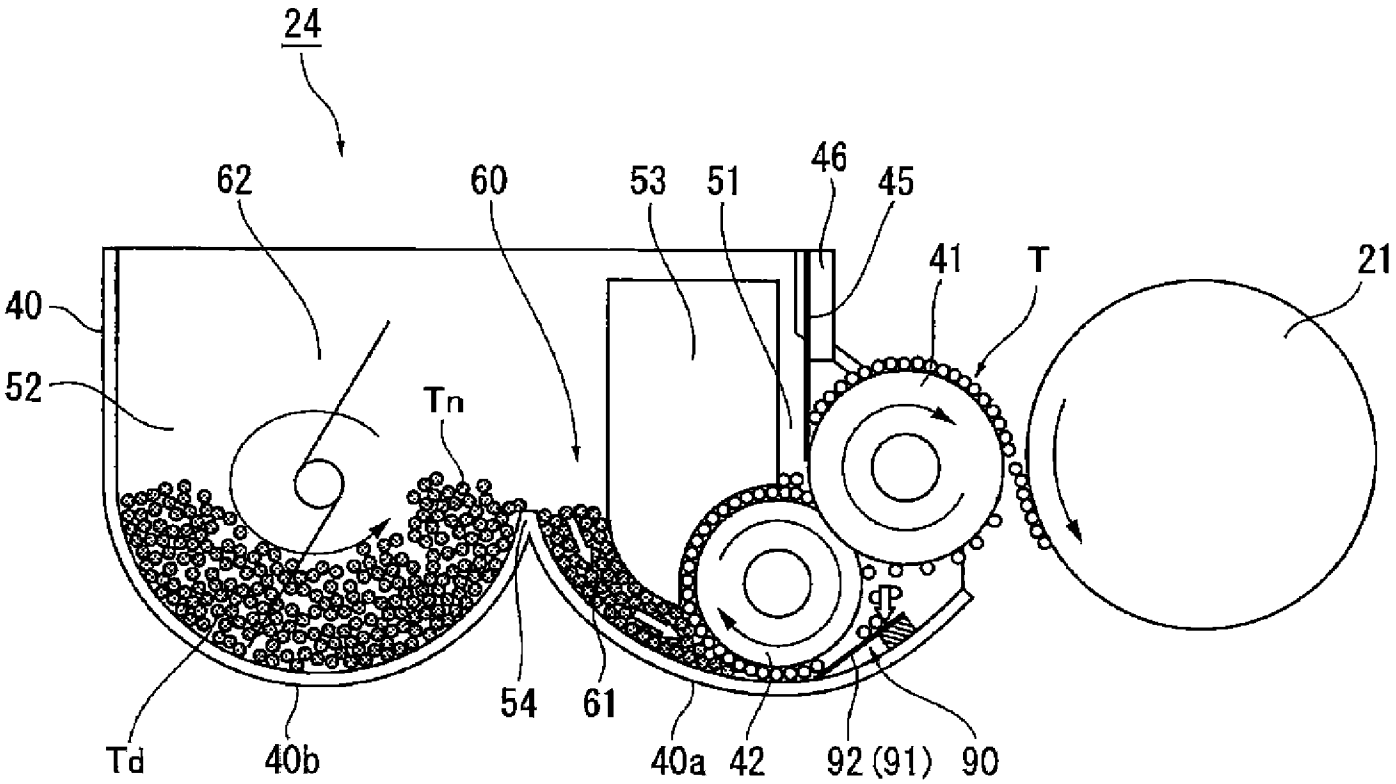
FIG. 3 is a diagram illustrating a developing device used in Exemplary Embodiment 1.
Figure 4:
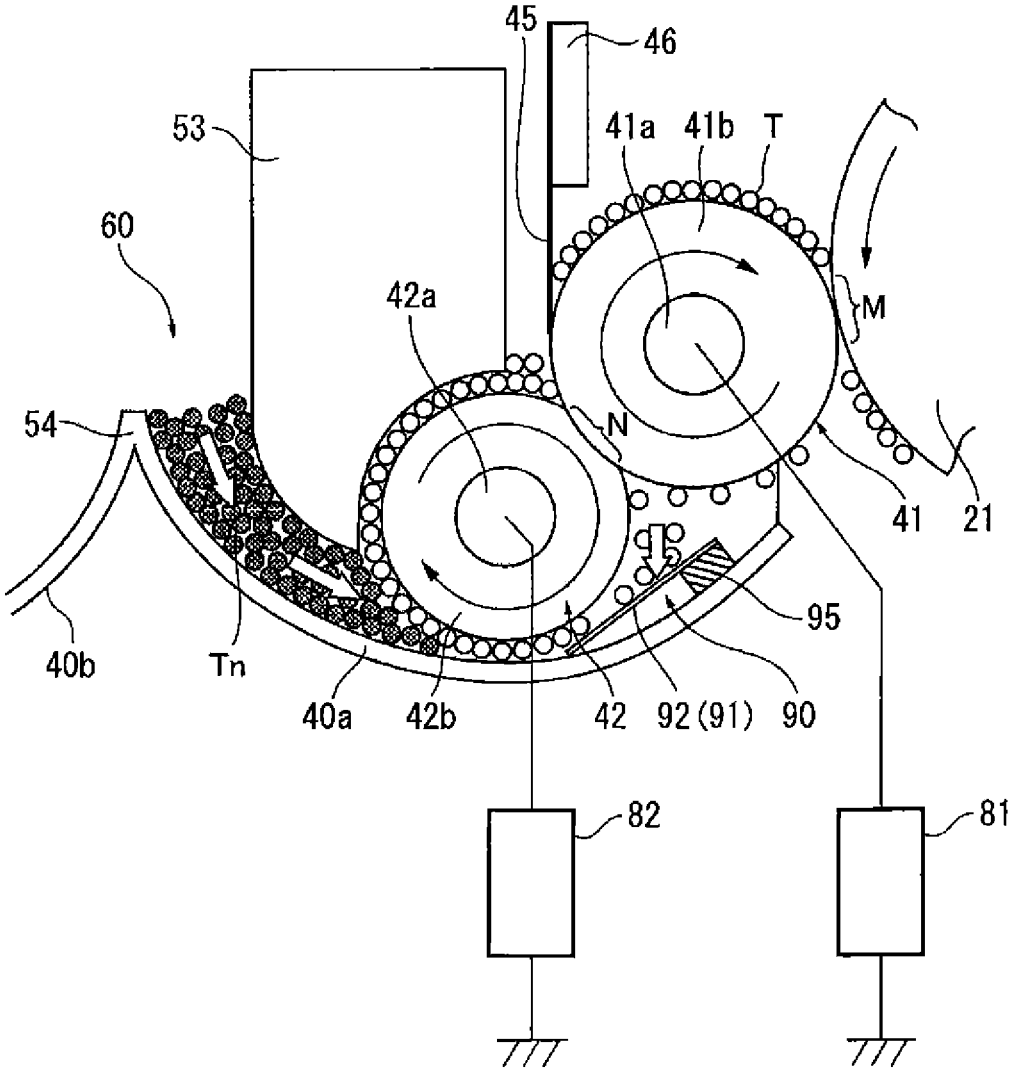
FIG. 4 is a diagram illustrating a main portion of the developing device shown in FIG. 3.

In the developing device 24 according to the present exemplary embodiment, as shown in FIG. 3, the supply roller 42 rotates in a state of capturing the toner T and transports the toner to the contact region N with the developing roller 41.

In this example, since the developing roller 41 and the supply roller 42 move in directions opposite to each other in the contact region N, when the toner T captured in the supply roller 42 passes through the contact region N, some of the toner T is supplied to the developing roller 41, and the other thereof remains in a state of being captured in the supply roller 42 or is peeled off and then falls downward.

At this time, the toner T supplied to the developing roller 41 passes through the charging blade 45 according to the rotation of the developing roller 41, is friction-charged when passing the charging blade 45, is restricted to a predefined amount, is transported to the developing region M between the developing roller 41 and the photoconductor 21, and is used to develop a latent image formed on the photoconductor 21.

Figure 6A:
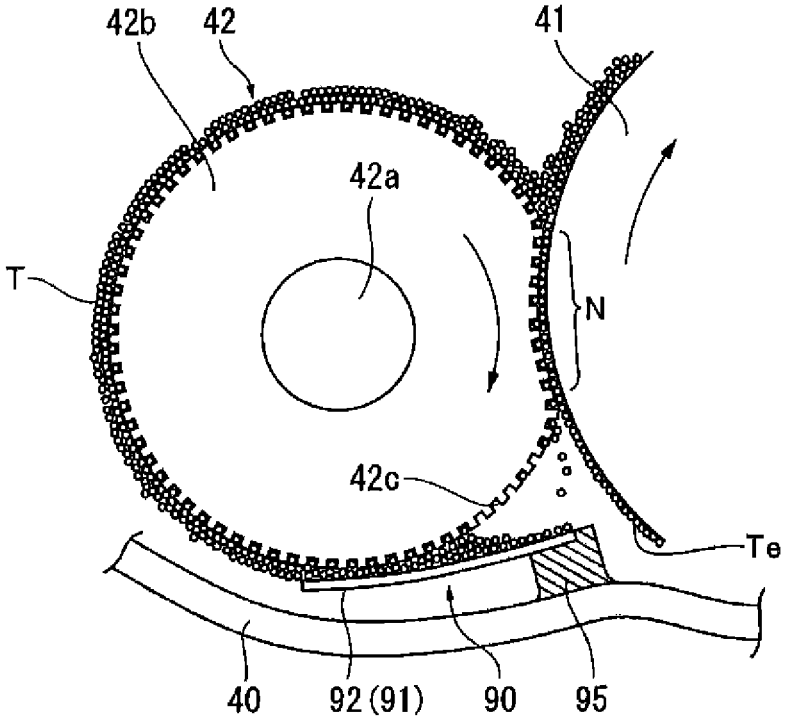
FIG. 6A is a diagram illustrating a behavior of toner around a contact region between a supply roller and a developing roller.

In addition, the remaining unused toner Te which has passed through the developing region M of the developing roller 41 is transported to the contact region N between the developing roller 41 and the supply roller 42 according to the rotation of the developing roller 41, and a lot of the remaining unused toner Te is scraped out and peeled off in the contact region N (refer to FIG. 6A).

In addition, the peeled toner Td (refer to FIG. 6B) which is peeled off in the contact region N between the developing roller 41 and the supply roller 42 is attached to the supply roller 42 via the attachment mechanism 90, and is re-transported according to the rotation of the supply roller 42 in a state of being captured along with the remaining toner Ta (refer to FIG. 6B) which remains in the supply roller 42.

Further, when toner captured in the peripheral surface of the supply roller 42 is not sufficient, the toner replenishment mechanism 60 replenishes the new toner Tn (refer to FIG. 7) to the peripheral surface of the supply roller 42.

In this way, a series of developing operations is performed by the developing device 24.

Behavior of Toner by Attachment Mechanism

In the developing operation process of the developing device 24, a behavior of the toner by the attachment mechanism 90 is as follows.

As shown in FIG. 6A, the supply roller 42 has the elastic layer 42*b* formed by, for example, a foam body, is thus depressed in a form following the surface of the developing roller 41 in the contact region N between the developing roller 41 and the supply roller 42, and is recovered to an original state before being elastically deformed after passing through the contact region N. For this reason, in the supply roller 42, linear velocity of the peripheral surface increases according to recovering deformation after passing through the contact region N, a repulsive force is generated by the recovery of the elastic layer 42*b*, and thereby some of the toner T which is captured in the rough surface 42*c* of the peripheral surface of the supply roller 42 is peeled off.

On the other hand, the remaining unused toner Te which is not used for development in the developing region M of the developing roller 41 is transported to the contact region N according to the rotation of the developing roller 41, but the remaining unused toner Te which is held on the developing roller 41 is scraped out and peeled off in a portion located on the upstream side (corresponding to the downstream side in the rotation direction of the supply roller 42) in the rotation direction of the developing roller 41 in the contact region N.

Figure 6B:
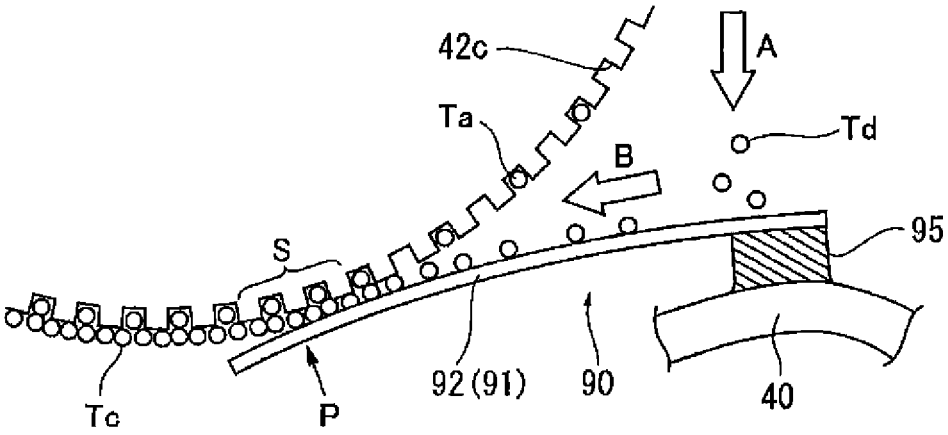
FIG. 6B is a diagram illustrating a behavior of peeled toner.

In this way, the peeled toner Td which is peeled off in the contact region N falls downward as indicated by the arrow A in FIG. 6B, and is caught and is piled on the elastic sheet 92 which is the guide member 91 of the attachment mechanism 90.

In this state, since the elastic sheet 92 has the smoothing surface 93 as a surface, and is obliquely disposed diagonally downward toward the pressing contact location S with the supply roller 42 with respect to the catching location of the peeled toner Td, the peeled toner Td caught on the elastic sheet 92 rolls and moves along the tilted smoothing surface 93 of the elastic sheet 92 and moves toward the pressing contact location S with the supply roller 42 as indicated by the arrow B in FIG. 6B.

In addition, since a contact force P at the pressing contact location S of the elastic sheet 92 gradually increases toward the front end of the elastic sheet 92 due to a curvature of the peripheral surface of the supply roller 42, the peeled toner Td which moves on the surface of the elastic sheet 92 arrives at the pressing contact location S of the elastic sheet 92 and is gradually pressed so as to be friction-charged between the elastic sheet 92 and the supply roller 42 and to be captured along with the remaining toner Ta which remains on the rough surface 42*c* of the peripheral surface of the supply roller 42.

At this time, since the contact force P of the elastic sheet 92 is substantially uniformly distributed over the pressing contact location S in an axis direction of the supply roller 42, a toner transport amount on the peripheral surface of the supply roller 42 is stably defined by the elastic sheet 92, and is averaged in the axis direction. For this reason, the peeled toner Td is pressed to the supply roller 42 by the contact force P of the elastic sheet 92 in addition to the remaining toner Ta, and is adhered and is attached to the peripheral surface of the supply roller 42 by an image force of the toner. As a result, when passing through the pressing contact location S of the elastic sheet 92, the old toner Tc including the remaining toner Ta and the peeled toner Td is captured in the peripheral surface of the supply roller 42, and is re-transported according to the rotation of the supply roller 42.

As above, since a lot of the peeled toner Td is attached to the peripheral surface of the supply roller 42, a situation is prevented in which the peeled toner Td is piled in the developing chamber 51 located on the lower side of the contact region N.

Behavior of Toner by Toner Replenishment Mechanism

Behaviors of New Toner and Old Toner in Replenishment Region

Figure 7A:
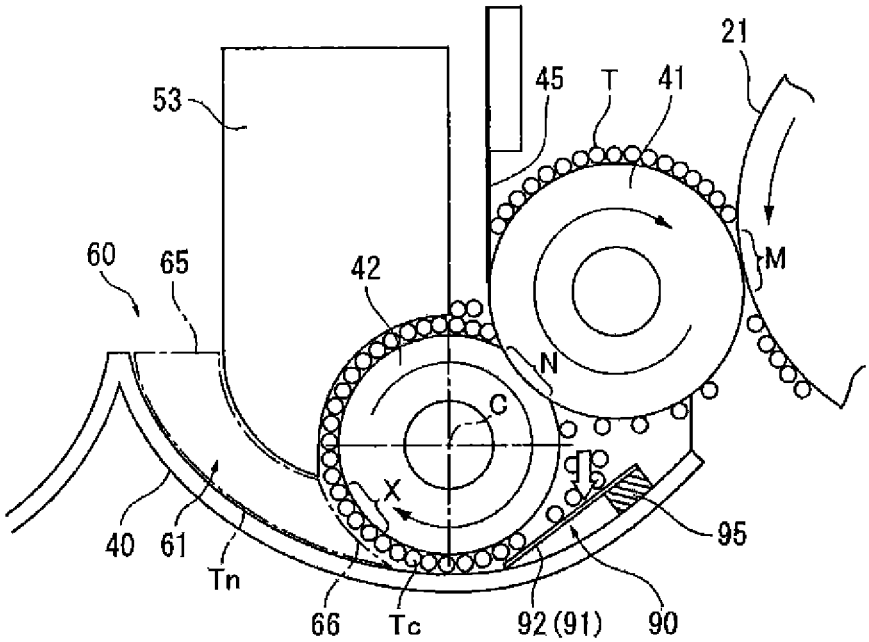
FIG. 7A is a diagram illustrating a behavior of toner around a replenishment region of new toner.

In this way, the supply roller 42 re-transports not the new toner Tn but the old toner Tc, and arrives at the replenishment region X by the toner replenishment mechanism 60 as shown in FIG. 7A.

In this example, the toner replenishment mechanism 60 has the curved toner transport path 61 in which the accommodation chamber 52 is connected to the developing chamber 51, the developing chamber side opening 66 of the toner transport path 61 is disposed so as to face the supply roller 42, and the developing chamber side opening 66 is located on the lower side of the accommodation chamber side opening 65 of the toner transport path 61.

Therefore, the toner transport path 61 is filled in a state in which the new toner Tn stays at a substantially constant amount, a pushing force by a weight of the staying part (the part indicated by the dot chain line in FIG. 7A) of the new toner Tn is applied to the developing chamber side opening 66, and an interface by the staying part of the new toner Tn is formed with the toner in the developing chamber 51.

In addition, the new toner Tn accommodated in the accommodation chamber 52 is transported to the toner transport path 61 side by the agitator 62, but the new toner Tn already fills the toner transport path 61 in a staying state, and thus a filling amount of the new toner Tn staying at the toner transport path 61 does not almost vary.

Further, in this example, the developing chamber side opening 66 of the toner transport path 61 is formed on the lower side of the central position C of the supply roller 42. The toner transport path 61 is formed in a curved shape, and extends slightly diagonally downward in the transverse direction in the location arriving at the developing chamber side opening 66.

On the other hand, a layer of the old toner Tc captured in the supply roller 42 is formed around the supply roller 42, and moves so as to face the developing chamber side opening 66 of the toner transport path 61 according to the rotation of the supply roller 42.

In addition, since the supply roller 42 rotates in a direction approaching the toner transport path 61 upward from the bottom in the location facing the developing chamber side opening 66, a pressing direction by the new toner Tn from the developing chamber side opening 66 of the toner transport path 61 and the rotation direction of the supply roller 42 are directions opposite to each other, and thus old toner Tc re-transported by the supply roller 42 is re-transported in a state of being smoothly attached by the attachment mechanism 90. For this reason, in the developing chamber side opening 66, the old toner Tc on the supply roller 42 moves along the interface by the staying part of the new toner Tn of the toner transport path 61 in a state in which the old and new toners are hindered from being mixed.

In relation to this, in the present exemplary embodiment, if the developing chamber side opening 66 of the toner transport path 61 is formed on the upper side of the central position C of the supply roller 42, the supply roller 42 rotates in a direction in which the supply roller 42 becomes separate from the toner transport path 61 in the upper region of the central position C of the supply roller 42, and thus the new toner Tn located at the interface of the staying part of the new toner Tn is easily drawn according to the rotation of the supply roller 42, and, accordingly, there is concern that the new toner Tn may easily enter the supply roller 42 side. Thereby, it is understood that the present exemplary embodiment is preferable.

In addition, also in a case where the rotation direction of the supply roller 42 is a reverse direction (a direction in which the supply roller 42 rotates downward from the top in the location adjacent to the developing chamber side opening 66), there is concern that the interface of the staying part of the new toner Tn may be drawn according to the rotation of the supply roller 42, and thus the new toner Tn may easily enter the supply roller 42 side. Thereby, it is understood that the present exemplary embodiment is preferable.

Capturing State I (Sufficient) of Old Toner by Supply Roller

Figure 7B:
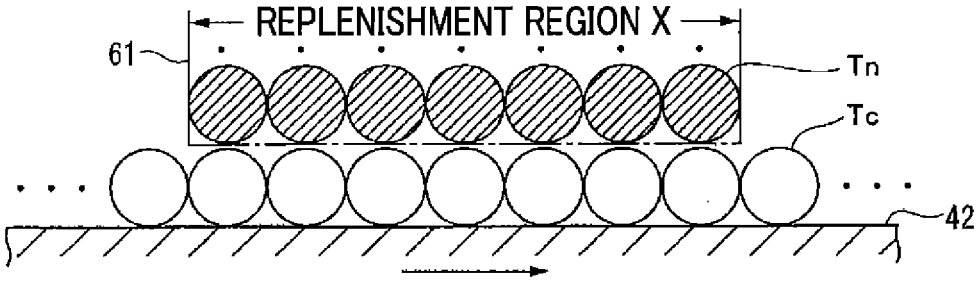
FIG. 7B is a diagram illustrating a behavior of toner in the replenishment region of new toner when re-transport toner (old toner) is sufficiently captured in the supply roller.

In this state, in a case where the old toner Tc which is re-transported toner is sufficiently captured in the supply roller 42 as shown in FIG. 7B, there is no residual toner capturing space in the peripheral surface of the supply roller 42, and thus it is difficult for the new toner Tn staying at the toner transport path 61 to be captured in the peripheral surface of the supply roller 42.

In addition, since the new toner Tn staying at the toner transport path 61 presses the peripheral surface of the supply roller 42, the old toner Tc captured in the supply roller 42 is blocked by the interface by the new toner Tn staying at the toner transport path 61, there is little concern that the old toner Tc may be mixed with the new toner Tn in the toner transport path 61.

Capturing State II (Insufficient) of Old Toner by Supply Roller

Figure 7C:
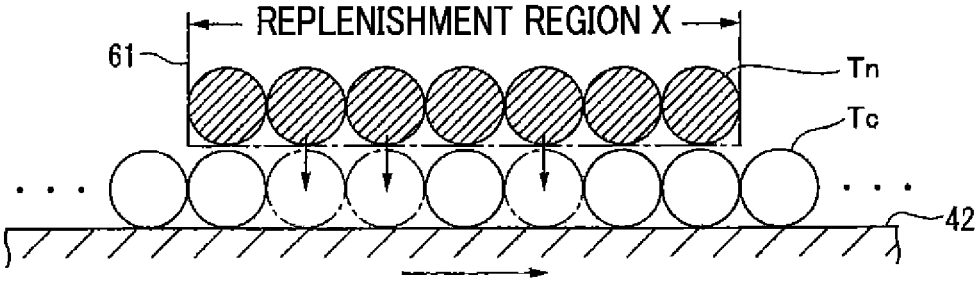
FIG. 7C is a diagram illustrating a behavior of toner in the replenishment region of new toner when re-transported toner (old toner) is insufficiently captured in the supply roller.

On the other hand, in a case where the old toner Tc which is re-transported toner captured in the supply roller 42 is not sufficient as shown in FIG. 7C, the new toner Tn staying at the toner transport path 61 presses the peripheral surface of the supply roller 42 by its own weight, and thus the new toner Tn is replenished to a location where the old toner Tc is not captured in the supply roller 42.

As described above, since the new toner Tn is not replenished to the supply roller 42 in a case where the old toner Tc is sufficiently captured, and the new toner Tn is replenished thereto in a case where the old toner Tc is not sufficient, the old toner Tc and the new toner Tn are not mixed unnecessarily on the peripheral surface of the supply roller 42, and the old toner Tc is preferentially consumed.

Restriction of Amount of Toner Captured in Supply Roller

In addition, in the present exemplary embodiment, there is concern that peripheral toner may follow the old toner Tc captured in the peripheral surface of the supply roller 42 due to a viscosity and move according to the rotation of the supply roller 42.

However, in the present exemplary embodiment, since a curved restriction surface 70 is formed along the peripheral surface of the supply roller 42 with a predefined gap g in the partition member 53 adjacent to the developing chamber side opening 66 of the toner transport path 61, for example, even if residual toner other than toner captured around the supply roller 42 follows and moves at the location adjacent to the developing chamber side opening 66 of the toner transport path 61 or the bottom wall of the developing vessel 40, a residue of the toner captured on the peripheral surface of the supply roller 42 is scraped out when passing through the restriction surface 70 of the partition member 53, and thus an amount of toner captured in the supply roller 42 is restricted to a necessary amount.

COMPARATIVE EXAMPLE 1

Next, in order to evaluate a performance of the developing device according to Exemplary Embodiment 1, the performance thereof will be described by exemplifying a developing device according to Comparative Example 1.

Figure 8:
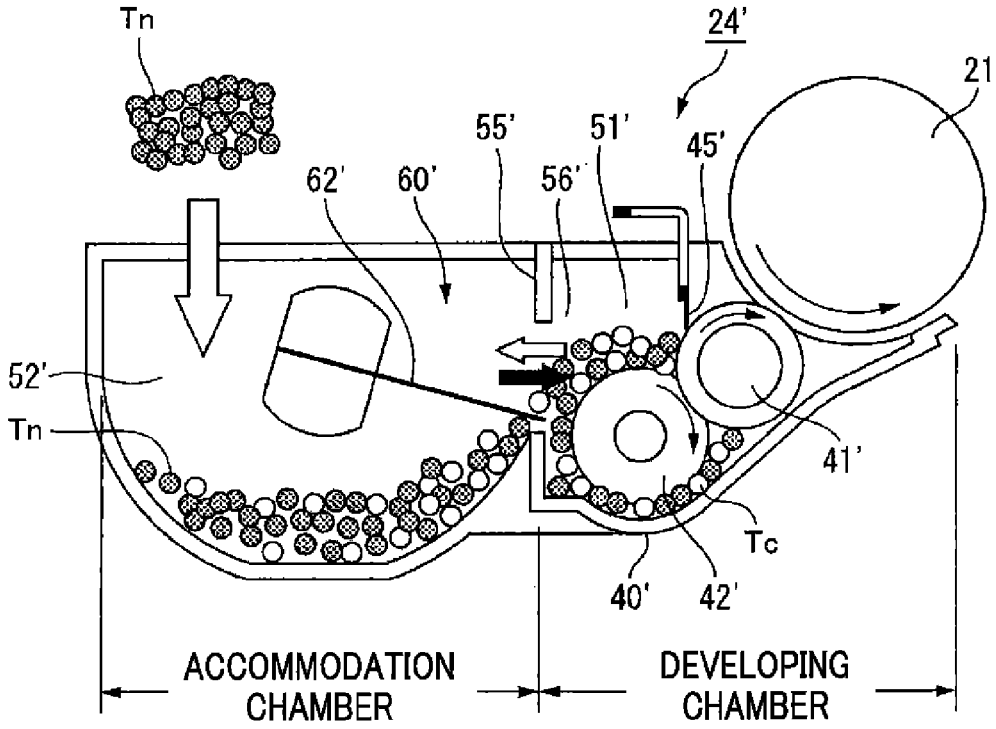
FIG. 8 is a diagram illustrating an example of a developing device according to Comparative Example 1.

FIG. 8 shows a developing device according to Comparative Example 1.

In FIG. 8, in the developing device 24', a partition wall 55' is provided in a developing vessel 40' so as to be partitioned into a developing chamber 51' and an accommodation chamber 52' of new toner Tn, and a toner transport hole 56' is formed at a part of the partition wall 55'. A developing roller 41', a supply roller 42', and a charging blade 45' are disposed in the developing chamber 51', and an agitator 62' is disposed in the accommodation chamber 52' as a toner replenishment mechanism 60'. In addition, "the partition member 53 with the restriction surface 70", "the new toner staying type toner transport path 61", and "the attachment mechanism 90" which are constituent elements employed in the developing device 24 according to Exemplary Embodiment 1 are not employed.

In this Comparative Example, the following operation is performed.

In other words, when a toner replenishment operation is started by the agitator 62', the new toner Tn in the accommodation chamber 52' is replenished from the toner transport hole 56' to inside of the developing chamber 51' such that an amount of the toner increases in the developing chamber 51', and when the new toner Tn exceeds the height of the toner transport hole 56', the old toner Tc reversely flows from the developing chamber 51' to the inside of the accommodation chamber 52'.

Further, peeled toner which is peeled off in the contact region NT between the developing roller 41' and the supply roller 42' is gradually piled in the developing chamber 51', and receives a friction stress with the supply roller 42' without any consumption and is mixed with the new toner Tn.

In addition, when the new toner Tn and the old toner Tc are mixed in the developing chamber 51', an external additive of the old toner Tc is torn off, or the external additive is buried in toner particle base substances, and thus the old toner Tc has a coat level which is considerably different from the new toner Tn. Therefore, when both of the two are mixed, mutual charging is caused by the charging blade 45', and thus electric charge distributions between the new toner Tn and the old toner Tc are considerably different. For this reason, poorly charged toner is easily generated, and a fogging phenomenon easily occurs in which the poorly charged toner is unnecessarily scattered in a background part of a recording material.

As described above, in this Comparative Example, a situation in which the old and new toners are unnecessarily mixed on the supply roller 42' cannot be suppressed, whereas, in Exemplary Embodiment 1, the new toner staying type toner replenishment mechanism 60 or the attachment mechanism 90 is employed, and thus it is understood that the defect of the developing device according to Comparative Example 1 can be improved.

Toner Ejection Control

In the present exemplary embodiment, the controller 100 performs toner ejection control for forcing toner in the developing device 24 to be ejected in a case where an amount of consumed toner is smaller than a predefined restriction amount.

In the configuration (refer to FIG. 3) of the developing device 24 of this example, in a case where the number of output images is small, and an amount of consumed toner is too small, toner on the supply roller 42 or remaining unused toner on the developing roller 41 repeatedly passes through the contact region N between the developing roller 41 and the supply roller 42, and some of toner is peeled off and is attached to the supply roller 42 again by the attachment mechanism 90 so as to be re-transported. Therefore, there is a possibility that old toner other than new toner may be circulated on the developing roller 91 and/or the supply roller 42 in a state of not being consumed. In this state, an extra stress is applied to the toner, and, thus, for example, an external additive of the toner is buried, or the external additive is peeled off from the toner. Thereby, there is an increasing tendency that charging characteristics of the toner varies, or fluidity of the toner varies. If the characteristics of the toner vary, there is concern that a charging amount of toner may be reduced so as to cause a background fogging, or if the fluidity of the toner is reduced, there is concern that the toner is fixed to the charging blade 45 so as to cause image disturbance (for example, stripe-shaped image disturbance).

Figure 9:
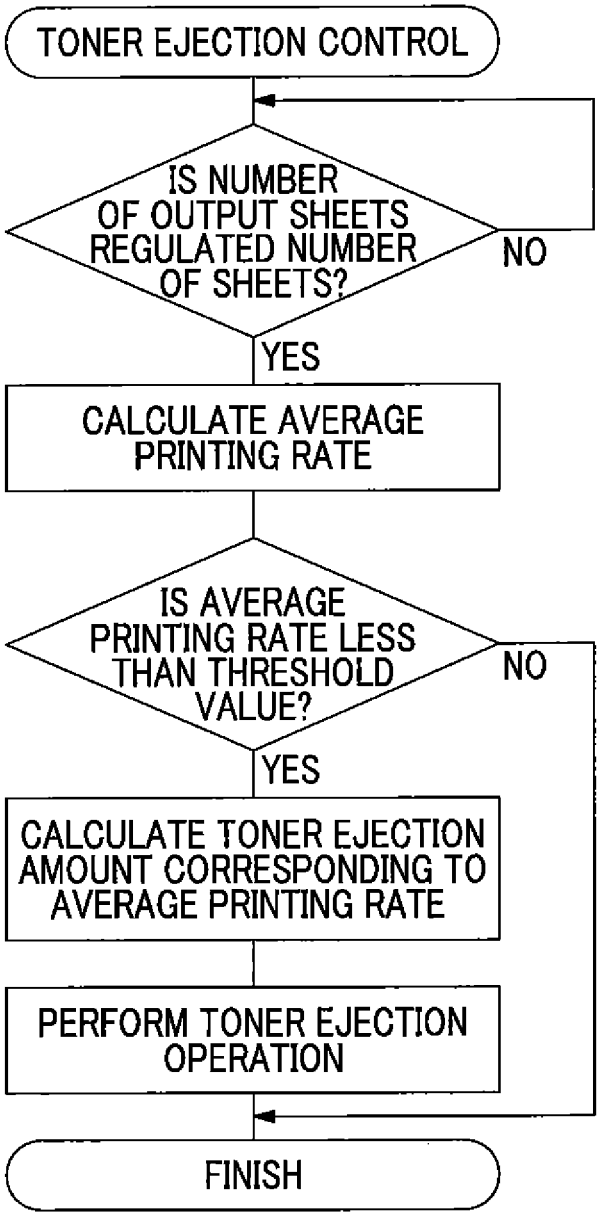
FIG. 9 is a flowchart illustrating a toner ejection control process employed in the present exemplary embodiment.

Therefore, in the present exemplary embodiment, toner ejection control as shown in FIG. 9 is performed.

If the toner ejection control is to be performed, as shown in FIG. 9, first, it is determined whether or not the number of output sheets arrives at a predefined regulated number of sheets such as 500 sheets. This is continued until the number of output sheets arrives at the regulated number of sheets, and if arriving at the regulated number of sheets, an average printing rate is calculated from image information hitherto by dividing a total dot count number (accumulation of a total dot number of an image part for each sheet) by a total output area (a product of a total dot number including an image part corresponding to an image forming region and a non-image part for each sheet and the number of output sheets).

Next, it is discriminated whether or not the calculated average printing rate is less than a predefined threshold value. At this time, if it is discriminated that the calculated average printing rate is equal to or more than the threshold value, it is determined that the toner is consumed to an extent and thus there is no concern that the toner deteriorates, and the toner ejection control finishes.

On the other hand, if it is discriminated that the calculated average printing rate is not equal to or more than the threshold value, that is, the average printing rate is less than the threshold value, it is determined that deterioration in the toner is in progress, and a toner ejection amount corresponding to the average printing rate is calculated. At this time, as a method of calculating the toner ejection amount, a method may be employed in which a larger ejection amount is used in a case where the average printing rate is low than in a case where the average printing rate is high; a calculation formula for calculating a relationship between an average printing rate and a toner ejection amount may be obtained in advance, and the toner ejection amount may be obtained according to this calculation formula; and an average printing rate may be divided into several groups, and a toner ejection amount corresponding to each group may be determined in advance.

In addition, when the toner ejection amount is calculated, the charging device 22, the exposure device 23, the developing device 24, and the transfer device 25 may be controlled so as to form a latent image for ejection corresponding to the calculated toner ejection amount on the photoconductor 21, and the toner ejection operation may be performed in a form of developing the latent image with the developing device 24. Through this toner ejection, not only the toner on the developing roller 41 but also the toner attached onto the supply roller 42 is consumed, and thus the old toner which may deteriorate in the developing device 24 is removed.

In addition, the toner ejected onto the photoconductor 21 is cleaned off by the cleaning device 26.

This toner ejection operation is performed at a timing different from a timing when a normal image is output. For example, the toner ejection operation may be appropriately performed in a range in which the image forming apparatus is not used to form a normal image, such as, for example, an image output pause period, the time when an operation of the image forming apparatus starts, or the operation thereof stops. In addition, in a case where the cleaning device 26 cleans off toner on the photoconductor 21 when this toner ejection operation is performed, the transfer device 25 may not be operated such that the toner on the photoconductor 21 does not transition to the transfer device 25 side, or, if the transfer device 25 is of a contact type, the transfer device 25 may be separated from the photoconductor 21 or an electric field may be applied between the transfer device 25 and the photoconductor 21 in a direction in which the toner is not attached to the transfer device 25 side. Further, although, in this example, the toner ejected onto the photoconductor 21 through the toner ejection operation is removed by the cleaning device 26, alternatively, for example, the toner may be transferred onto the recording material 28, or another cleaning device may be provided so as to remove the toner.

Although, in the present exemplary embodiment, an aspect is described in which an average printing rate per sheet is calculated from a cumulative consumed toner amount when a predefined number of output sheets arrives, and an extent of deterioration in toner is determined, determination of an extent of deterioration in toner is not limited thereto, and may be performed as follows.

For example, a toner amount per unit time may be calculated from a toner amount consumed until a working time of the developing device 24 arrives at a predefined time, and an extent of deterioration in toner may be determined based on whether or not the toner amount per unit time is equal to or more than a predefined threshold value. In this case, if the toner amount per unit time is small, the toner ejection operation may be performed.

In addition, an extent of deterioration in toner may be determined based on to what degree an output in which a consumed toner amount per sheet is smaller than a predefined threshold value is continuously performed. Typically, in an image output in which a picture image output and a character image output are mixed, an average printing rate is influenced by the picture image output and thus increases. For this reason, for example, in a case where most of outputs are character images, and picture images are mixed a little, it is expected that outputs of a low printing rate are continued. Therefore, a state is grasped in which outputs of a small consumed toner amount are continued in the number of output images, and if the outputs are too continued, it is determined that the toner may deteriorate, and ejection of toner may be performed.

Furthermore, an environmental condition may be added to an extent of deterioration in toner.

Modification Example of Attachment Mechanism

Although, in the present exemplary embodiment, the attachment mechanism 90 may employ a method in which the elastic sheet 92 is used as the guide member 91, one end side of the elastic sheet 92 is fixed, and the other side thereof comes into pressing contact with the peripheral surface of the supply roller 42, the attachment mechanism 90 is not limited thereto and may be appropriately modified in design as in Modification Examples 1-1 to 1-3.

MODIFICATION EXAMPLE 1-1

Figure 10A:
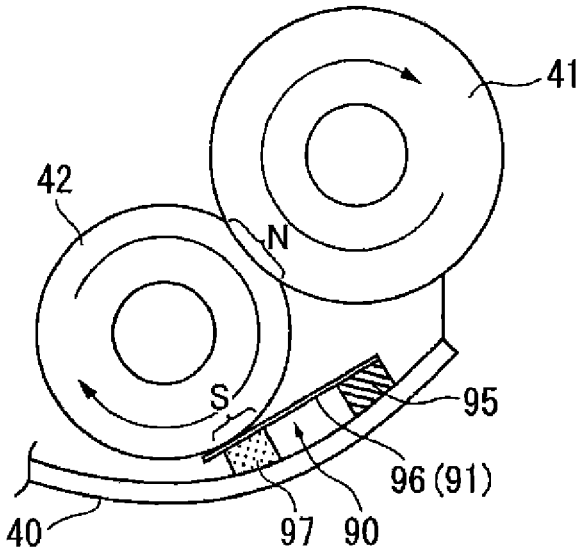
FIGS. 10A to 10C are diagrams illustrating modified examples of the attachment mechanism used in the present exemplary embodiment.

The attachment mechanism 90 shown in FIG. 10A is provided as follows. A bending deformable sheet member 96 is used as the guide member 91; one end of the sheet member 96 is fixed to the attached member 95, and a free end side thereof comes into pressing contact with the supply roller 42; and a biasing member 97 which biases the sheet member 96 toward the supply roller 42 side so as to be pressed is provided between the portion corresponding to the pressing contact location S with the supply roller 42 of the sheet member 96 and the inner wall of the developing vessel 40. Here, an elastic body or a plate spring may be used as the biasing member 97.

By using the biasing member 97, a pressing contact condition of the sheet member 96 with the supply roller 42 is maintained to be substantially constant. Thereby, peeled toner arriving at the pressing contact location S of the sheet member 96 is attached to the supply roller 42 under an action of a more stable contact force.

In addition, in Modification Example 1-1, the sheet member 96 may be the elastic sheet 92 used in Exemplary Embodiment 1, but a sheet itself is not necessarily required to be disposed so as to come into pressing contact with the supply roller 42 unlike the elastic sheet 92, and a plate spring made of metal (for example, SUS) may be appropriately selected as long as it at least has a surface on which peeled toner can roll and move, and can be deformed so as to be bent by being pressed by the biasing member 97.

MODIFICATION EXAMPLE 1-2

Figure 10B:
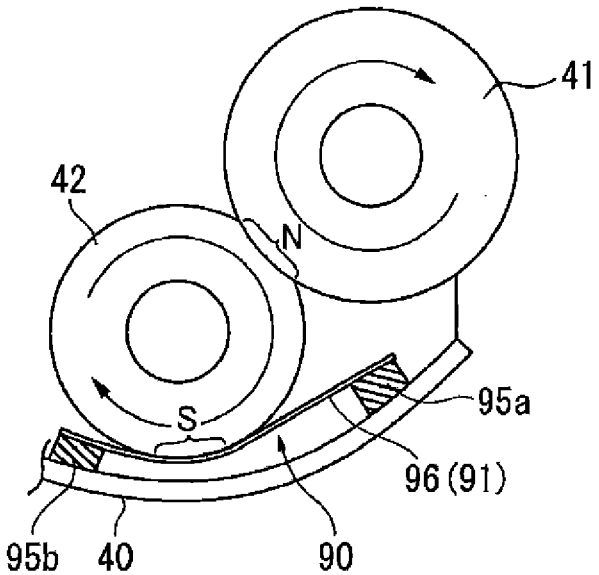

In addition, the attachment mechanism 90 shown in FIG. 10B is provided as follows. A bending deformable sheet member 96 is used as the guide member 91; the sheet member 96 is disposed facing the supply roller 42 so as to reach up to an opposite region from a lower region of the contact region N between the supply roller 42 and the developing roller 41 with the lowest part of the supply roller interposed therebetween; the vicinities of both ends of the sheet member 96 are respectively fixed to attached members 95 (95*a* and 95*b*) provided in the developing vessel 40; and an intermediate part of the sheet member 96 comes into pressing contact with the vicinity of the lowest part of the supply roller 42. Here, as a method of adjusting a contact force by the sheet member 96, for example, there may be a method in which a tension state of the sheet member 96 for the attached members 95 is adjusted using a material which can be elastically deformed in a surface direction as the sheet member 96.

In this aspect, since the sheet member 96 is provided so as to pass through the lowest part of the supply roller 42, the pressing contact location S with the supply roller 42 by the sheet member 96 is widely secured. In addition, in this aspect, the upstream side part in the rotation direction from the lowest part of the supply roller 42 in the sheet member 96 is required to be obliquely disposed diagonally downward toward the lowest part of the supply roller 92 from the catching location of peeled toner corresponding to the lower side of the contact region N between the developing roller 41 and the supply roller 42. Thereby, peeled toner caught in the sheet member 96 sufficiently comes into pressing contact with and is attached to the supply roller 42 at the pressing contact location S with the supply roller 42.

MODIFICATION EXAMPLE 1-3

Figure 10C:
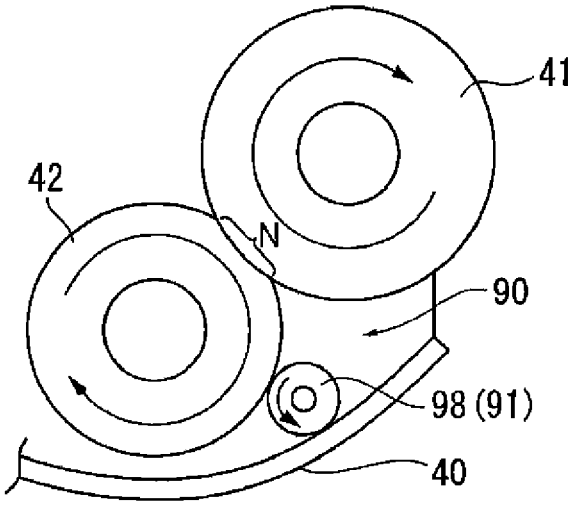

The attachment mechanism 90 shown in FIG. 10C is provided as follows. A rotation roller 98 with a smooth surface is used as the guide member 91; the rotation roller 98 is disposed in a state of coming into pressing contact with the peripheral surface of the supply roller 42 so as to correspond to the lower side of the contact region N between the developing roller 41 and the supply roller 42; and the rotation roller 98 rotates following the rotation of the supply roller 42.

In this example, a region located further toward the supply roller 42 side than the uppermost part of the rotation roller 98 in the peripheral surface of the rotation roller 98 is disposed at a position where peeled toner which is peeled off from the contact region N between the developing roller 41 and the supply roller 42 can be caught.

In this example, since the rotation roller 98 rotates following the rotation of the supply roller 42, when peeled toner which is peeled off from the contact region N falls on the peripheral surface of the rotation roller 98, the peeled toner is guided to the pressing contact location S between the rotation roller 98 and the supply roller 42 and is attached to the supply roller 42.

Exemplary Embodiment 2

Figure 11A:
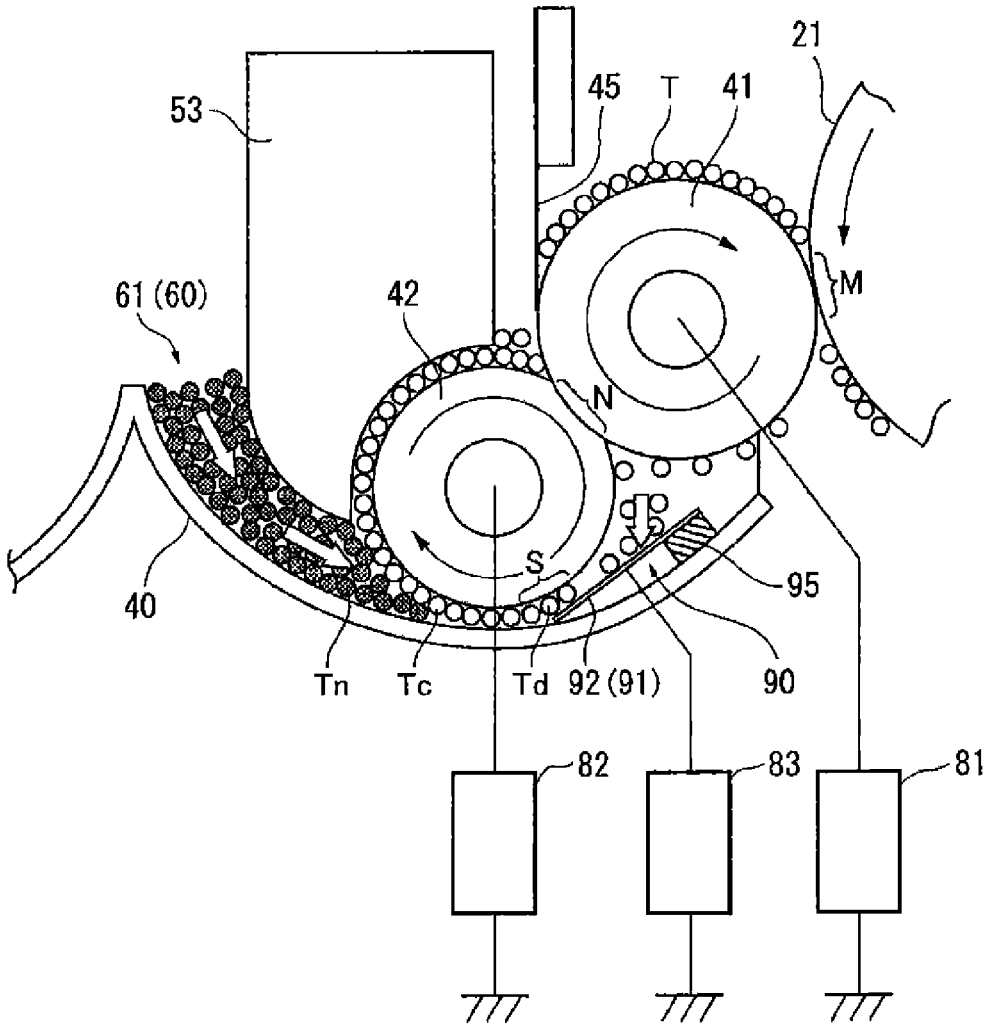
FIG. 11A is a diagram illustrating a main portion of a developing device according to Exemplary Embodiment 2.

FIG. 11A shows a main portion of a developing device according to Exemplary Embodiment 2.

In FIG. 11A, a basic configuration of the developing device 24 is substantially the same as in Exemplary Embodiment 1, but an attachment mechanism 90 different from in Exemplary Embodiment 1 is provided. In addition, the same constituent element as in Exemplary Embodiment 1 is given the same reference numeral, and detailed description thereof will be omitted here.

In the attachment mechanism 90 of this example, in the substantially same manner as Exemplary Embodiment 1, the elastic sheet 92 with a cantilever support structure is used as the guide member 91, and a suction power source 83 which can apply a suction voltage for forming a suction electric field is connected to the elastic sheet 92 in order to give conductivity to the elastic sheet 92 and to apply a suction electric field by which toner T interposed between the elastic sheet 92 and the supply roller 42 can be sucked to the supply roller 42 side.

In this example, as the elastic sheet 92, for example, a sheet which is adjusted to predefined volume resistivity by dispersing conductive fillers may be used. In addition, the suction electric field may be appropriately selected in consideration of the balance with a supply voltage which is applied to the supply roller 42, in a range in which unnecessary discharging does not occur between the supply roller 42 and the elastic sheet 92, from the viewpoint of further promoting suction of toner.

Figure 11B:
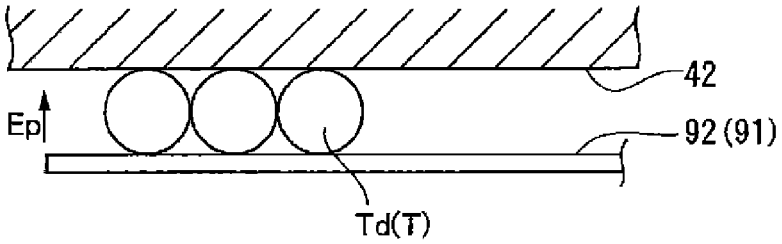
FIG. 11B is a diagram illustrating an operation thereof.

In the present exemplary embodiment, as shown in FIGS. 11A and 11B, a suction electric field Ep (an electric field which causes the elastic sheet 92 side to have the same polar direction as a charging polarity of toner) in a direction in which toner is sucked to the supply roller 42 side is applied between the supply roller 42 and the elastic sheet 92 by the suction power source 83. For this reason, the peeled toner Td (T) which arrives at the pressing contact location S of the elastic sheet 92 receives a force in a direction of being sucked by the electric field which acts on the supply roller 42 side and is rubbed more strongly between both of the two. Thereby, the peeled toner Td on the elastic sheet 92 is more strongly charged, and is thus more easily attached to the supply roller 42. As a result, the peeled toner Td is stably held in the supply roller 42, and the toner held in the supply roller 42 is transported toward the replenishment region X (a location corresponding to the developing chamber side opening 66 of the toner transport path 61) of the toner replenishment mechanism 60 according to the rotation of the supply roller 42.

In addition, although, in the present exemplary embodiment, an aspect is described in which the overall elastic sheet 92 is conductive, the elastic sheet 92 is not limited thereto, and a sheet with a laminate structure in which a side facing the supply roller 42 is used as a high resistance layer with volume resistivity of, for example, $10^9$ Ω·cm or more, and an opposite side is used as a conductive layer may be employed as the elastic sheet 92. In this case, the magnitude of a suction voltage of the suction power source 83 may be larger to that extent of including the high resistance layer than in a case where the overall elastic sheet 92 is conductive. In addition, the high resistance layer easily causes dielectric polarization by the suction power source 83, and an operation in which the elastic sheet 92 is sucked to the supply roller 42 side is expected to that extent. Further, although, in the present exemplary embodiment, the attachment mechanism 90 uses the cantilever support type elastic sheet 92 as the guide member 91, the attachment mechanism 90 is not limited thereto, and may employ the configurations as in the above-described Modification Examples 1-1 to 1-3.

Exemplary Embodiment 3

Figure 12A:
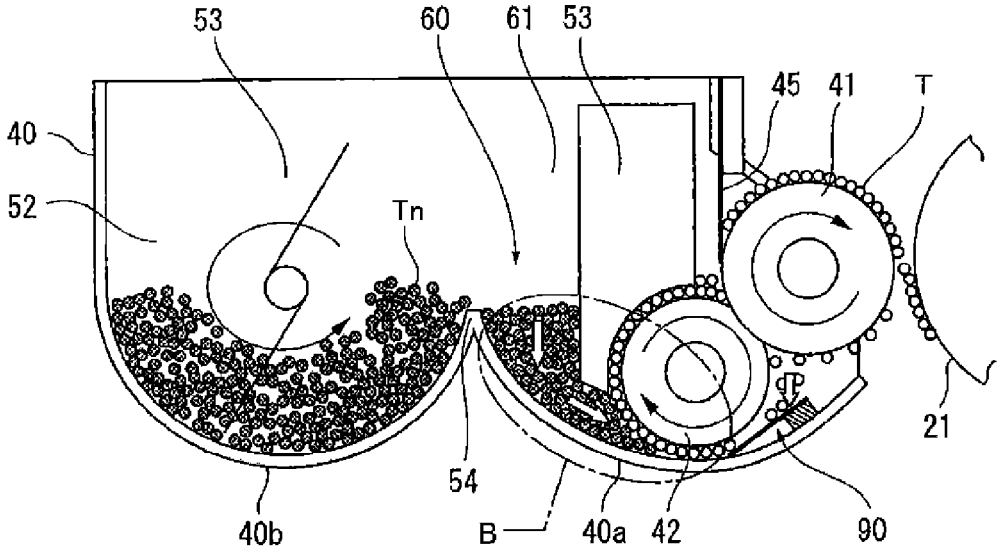
FIG. 12A is a diagram illustrating a main portion of a developing device according to Exemplary Embodiment 3.

FIG. 12A shows a main portion of a developing device according to Exemplary Embodiment 3.

In FIG. 12A, a basic configuration of the developing device 24 is substantially the same as in Exemplary Embodiment 1, but a structure of the toner transport path 61 of the toner replenishment mechanism 60 is different from in Exemplary Embodiment 1. In addition, the same constituent element as in Exemplary Embodiment 1 is given the same reference numeral as in Exemplary Embodiment 1, and detailed description thereof will be omitted here.

Figure 12B:
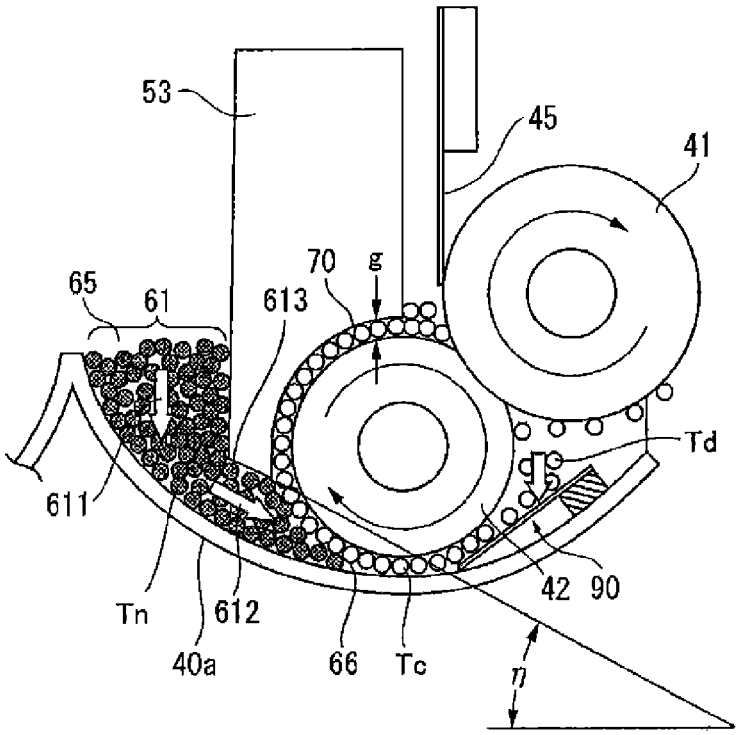
FIG. 12B is a diagram illustrating details of the portion B in FIG. 12A.

In the present exemplary embodiment, the fact that the developing chamber side opening 66 is disposed on the lower side of the accommodation chamber side opening 65 is the same as in Exemplary Embodiment 1, as shown in FIGS. 12A and 12B, the toner transport path 61 is different from in Exemplary Embodiment 1 in a shape thereof, and has a longitudinal path 611 which extends in the longitudinal direction following a substantially vertical direction and a transverse path 612 which bends from the longitudinal path 611 and extends in the transverse direction toward the supply roller 42 side.

In this example, the higher the longitudinal path 611 is, the higher the pressure on the peripheral surface of the supply roller 42 at the interface (a kind of wall) by the staying part of the new toner Tn can be. In addition, if the transverse cross-sectional width increases upward in a shape of the longitudinal path 611, a capacity of the new toner Tn which fills the longitudinal path 611 increases. Therefore, also in this way, it is possible to increase a pressure at the interface by the staying part of the new toner Tn.

In addition, the transverse path 612 bends and extends from the longitudinal path 611 in a desired direction when the interface by the staying part of the new toner Tn is formed at a location facing the peripheral surface of the supply roller 42.

Further, although the toner transport path 61 is partitioned and is formed between the partition member 53 and the curved part 40*a* which is a part of the bottom wall of the developing vessel 40, the upper wall which partitions the upper side of the transverse path 612 in the partition member 53 is obliquely disposed diagonally downward toward the supply roller 42 side from the longitudinal path 611, and a tilt angle η with respect to the horizontal direction is set to be equal to or less than a repose angle of toner to be used.

Here, the repose angle of toner is an index indicating fluidity, and, in this aspect, the tilt angle η of the upper wall of the transverse path 612 is set to be equal to or less than the repose angle of toner to be used with respect to the horizontal direction, and, accordingly, it is hard for each toner particle of the staying part of the new toner Tn which fills the transverse path 612 to flow. Therefore, there is an operation of alleviating an excessive pressure from the longitudinal path 611, and a pressure of the new toner Tn applied to the supply roller 42 can be adjusted through a combination of a height of the longitudinal path 611, a length of the transverse path 612, and the tilt angle η.

In addition, in the present exemplary embodiment, a bending part 613 with the transverse path 612 from the longitudinal path 611 in the partition member 53 has a shape with a corner, but the bending part 613 may be formed in a curved shape from the viewpoint of reducing movement resistance of the staying new toner Tn from the longitudinal path 611 to the transverse path 612.

Exemplary Embodiment 4

Figure 13:
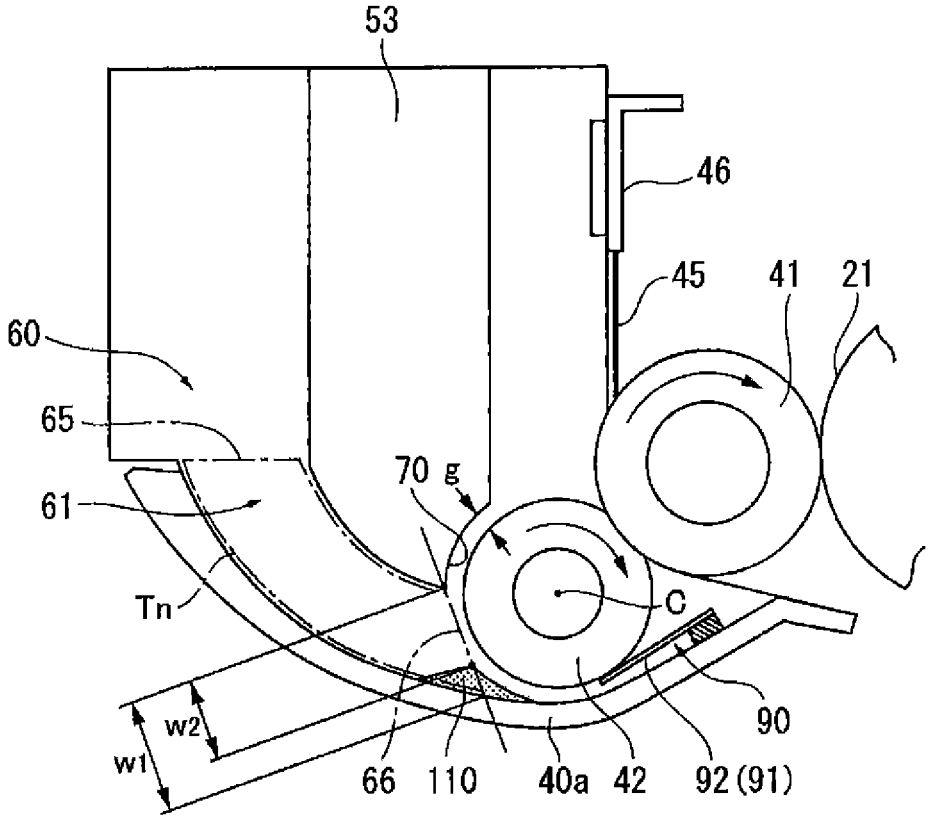
FIG. 13 is a diagram illustrating a main portion of a developing device according to Exemplary Embodiment 4.

FIG. 13 shows a main portion of a developing device according to Exemplary Embodiment 4.

In FIG. 13, a basic configuration of the developing device 24 is substantially the same as in Exemplary Embodiment 1, but a structure of the toner transport path 61 of the toner replenishment mechanism 60 is partially different from in Exemplary Embodiment 1. In addition, the same constituent element as in Exemplary Embodiment 1 is given the same reference numeral as in Exemplary Embodiment 1, and detailed description thereof will be omitted here.

In this example, in the substantially same as in Exemplary Embodiment 1, the toner transport path 61 is formed between the partition member 53 and the curved part 40*a* which is a part of the bottom wall of the developing vessel 40, the accommodation chamber side opening 65 is located on the upper side of the developing chamber side opening 66, and the toner transport path 61 is formed in a curved shape along the curved part 40*a* from the accommodation chamber 52 to the developing chamber 51.

Here, a width size w1 of the developing chamber side opening 66 of the toner transport path 61 in a direction following the rotation direction of the supply roller 42 is set to be smaller than an outer diameter d (refer to FIG. 5) of the supply roller 42 in a projection plane viewed from the supply roller 42 side, but the developing chamber side opening 66 is provided so as to reach the upper side of the central position C of the supply roller 42 unlike in Exemplary Embodiment 1. However, the curved restriction surface 70 which is opposite to the supply roller 42 and is formed along the peripheral surface of the supply roller 42 with the gap g is provided in the partition member 53 adjacent to the developing chamber side opening 66 in the same manner as in Exemplary Embodiment 1.

In the present exemplary embodiment, in the substantially same as in Exemplary Embodiment 1, the new toner Tn staying at the toner transport path 61 is pressed slightly diagonally downward from the developing chamber side opening 66, the old toner Tc captured in the supply roller 42 rolls and moves upward from the bottom at the location adjacent to the developing chamber side opening 66, and thus a phenomenon can be observed in which the old and new toners contact each other.

If this contact phenomenon of the old and new toners repeatedly occurs with the passage of time during use, a location where the staying part of the new toner Tn joins the old toner Tc captured in the supply roller 42 is generated around the lower edge of the developing chamber side opening 66 of the toner transport path 61. In this case, since the pressure by the own weight of the staying part of the new toner Tn acts on the peripheral surface of the supply roller 42, and the staying part of the new toner Tn is pressed by the torque of the old toner Tc captured in the supply roller 42, both the toners are gradually piled and are solidified in a soft blocking form at the joining location of both of the two, and an approximately triangular pile wall 110 (so-called dead toner) is formed by the toners.

As above, when the pile wall 110 is formed around the lower edge of the developing chamber side opening 66 of the toner transport path 61 with the passage of time during use, the old toner Tc captured in the supply roller 42 butts into the pile wall 110 immediately after arriving at the developing chamber side opening 66, and thus a situation in which the old toner Tc reversely flows to the toner transport path 61 side is more effectively hindered.

In addition, if this pile wall 110 is formed by the toners, the width size of the developing chamber side opening 66 which is originally w1 is substantially changed to w2 (w2<w1) due to the pile wall 110 being formed, and thus design may be performed in consideration of a situation in which the pile wall 110 is formed by the toners.

In addition, although the pile wall 110 is formed by the toners with the passage of time during use, a partition member corresponding to the pile wall 110 by the new toner Tn may be separately provided in the developing vessel 40.

Further, although, in the present exemplary embodiment, the developing chamber side opening 66 of the toner transport path 61 is formed so as to reach the upper side of the central position C of the supply roller 42, as long as the width size w1 (or w2) of the developing chamber side opening 66 in a direction following the rotation direction of the supply roller 42 is set to be smaller than the outer diameter d of the supply roller 42 in a projection plane viewed from the supply roller 42 side, the new toner Tn staying at the toner transport path 61 faces the developing chamber side opening 66 and touches the peripheral surface of the supply roller 42. Therefore, a situation in which the new toner Tn in the toner transport path 61 directly enters the developing chamber 51 is suppressed as compared with an aspect in which the developing chamber side opening 66 has a width size which is equal to or more than the outer diameter d of the supply roller 42.

Particularly, in this example, since the predetermined restriction surface 70 is formed in the partition member 53, even if residual toner tries to follow the toner captured in the peripheral surface of the supply roller 42, the residual toner is removed by the restriction surface 70 of the partition member 53, and thus an amount of toner captured in the peripheral surface of the supply roller 42 is restricted by the restriction surface 70.

Exemplary Embodiment 5

Figure 14A:
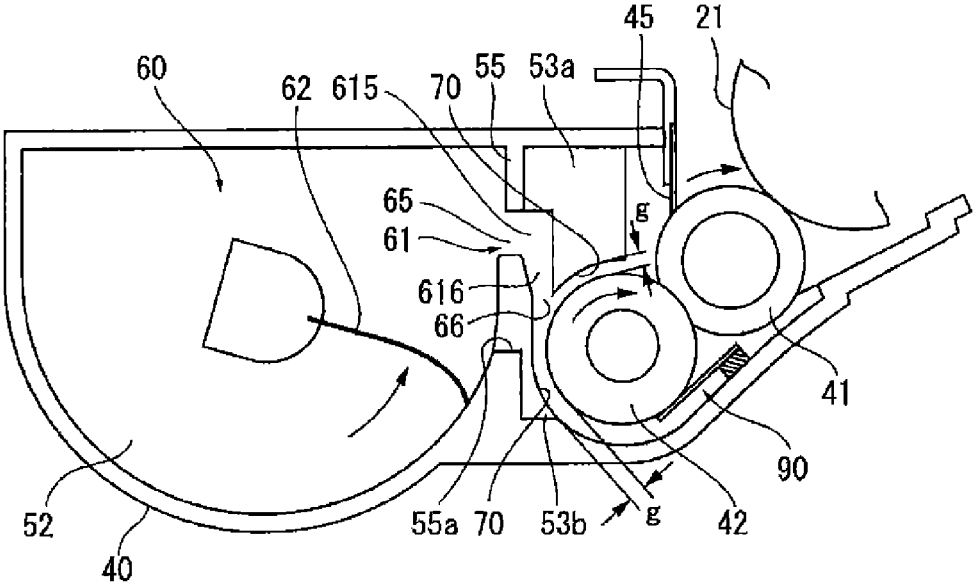
FIG. 14A is a diagram illustrating a main portion of a developing device according to Exemplary Embodiment 5.

FIG. 14A shows a main portion of a developing device according to Exemplary Embodiment 5.

In FIG. 14A, a basic configuration of the developing device 24 is substantially the same as in Exemplary Embodiment 1, but a partition structure of the toner replenishment mechanism 60 and the developing chamber 51 is different from in Exemplary Embodiment 1. In addition, the same constituent element as in Exemplary Embodiment 1 is given the same reference numeral as in Exemplary Embodiment 1, and detailed description thereof will be omitted here.

In this example, the developing vessel 40 is a vessel which is partitioned into the developing chamber 51 and the accommodation chamber 52 of the new toner Tn via a partition wall 55, and an opening 55*a* is formed in the partition wall 55.

In addition, around the opening 55*a* of the partition wall 55 in the developing chamber 51 inside the developing vessel 40, a downstream side partition member 53*a* is installed on the downstream side in the rotation direction of the supply roller 42, and an upstream side partition member 53*b* is installed on the upstream side in the rotation direction of the supply roller 42.

Here, the upstream side partition member 53*b* is installed in a part located on the upper side of the opening 55*a* of the partition wall 55, and is disposed so as to face the opening 55*a* and to protrude toward the supply roller 42.

On the other hand, the downstream side partition member 53*a* is installed in a part located on the lower side of the opening 55*a* of the partition wall 55, and is disposed so as to face the supply roller 42 and to overhang to inside of the opening 55*a*.

In this example, the toner replenishment mechanism 60 has the toner transport path 61 connected to the accommodation chamber 52 and the agitator 62 provided in the accommodation chamber 52. The toner transport path 61 has a transverse path 615 which is formed between the upstream side partition member 53*b* and the downstream side partition member 53*a* and extends in the transverse direction substantially following the horizontal direction, and a longitudinal path 616 which bends from the transverse path 615 and extends in the longitudinal direction substantially following the vertical direction toward the supply roller 42 side, and the developing chamber side opening 66 corresponding to an outlet of the longitudinal path 616 is located on the lower side of the accommodation chamber side opening 65 corresponding to an inlet of the transverse path 615.

Here, a width size of the developing chamber side opening 66 in the rotation direction of the supply roller 42 is set to be smaller than at least an outer diameter of the supply roller in a projection plane viewed from the supply roller 42 side, a position where the developing chamber side opening 66 is formed may be appropriately selected, and is set to the slightly upper side of the central position of the supply roller 42 in this example.

In addition, in this example, curved restriction surfaces 70 which are opposite to the supply roller 42 and are formed along the peripheral surface of the supply roller 42 with the gap g are respectively formed at locations adjacent to the developing chamber side opening 66 of the toner transport path 61 in the downstream side partition member 53*a* and the upstream side partition member 53*b*. Here, the gap g may be appropriately selected as long as it is selected to an extent that a toner layer to be captured in the supply roller 42 can be restricted, and, in this example, the gap is selected in a range of 0.5 mm to 1.0 mm. In addition, the meanings of the lower limit value and the upper limit values are substantially the same as those in Exemplary Embodiment 1.

In addition, regions where the restriction surfaces 70 of the partition members 53*a* and 53*b* are formed may be appropriately selected, and, in this example, the restriction surface 70 of the downstream side partition member 53*a* is formed from the developing chamber side opening 66 of the toner transport path 61 up to the vicinity of the uppermost part of the supply roller 42, and, on the other hand, the restriction surface 70 of the upstream side partition member 53*b* is formed from the developing chamber side opening 66 of the toner transport path 61 not up to the lowest part of the supply roller 42 but up to the downstream side of the lowest part in the rotation direction of the supply roller 42.

Figure 14B:
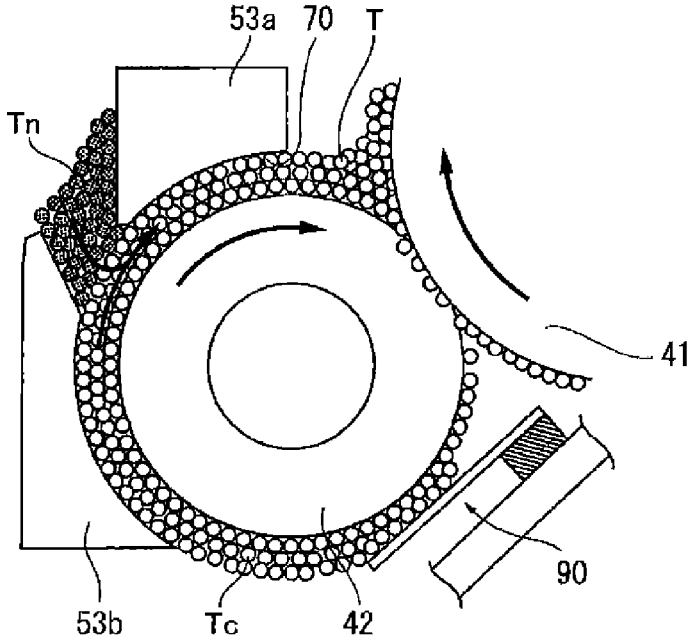
FIG. 14B is a diagram illustrating a behavior of toner around a supply roller in the same developing device.

Therefore, in the present exemplary embodiment, the toner replenishment mechanism 60 has a structure in which the new toner Tn in the accommodation chamber 52 is transported to the toner transport path 61 by the agitator 62, and the new toner Tn fills the toner transport path 61 in a staying state (refer to FIG. 14B).

For this reason, also in the present exemplary embodiment, peeled toner is attached to the peripheral surface of the supply roller 42 by the attachment mechanism 90, and thus the supply roller 42 captures and re-transports not the new toner Tn but the old toner Tc. In this state, when the old toner Tc captured in the supply roller 92 reaches the location facing the developing chamber side opening 66 of the toner transport path 61, in the substantially same manner as in Exemplary Embodiment 1, the staying part of the new toner Tn of the toner transport path 61 presses the peripheral surface of the supply roller 92 by its own weight, the interface by the staying part of the new toner Tn of the toner transport path 61 forms a kind of wall, and thus the old toner Tc captured in the supply roller 42 is transported along the peripheral surface of the supply roller 42 without entering the new toner Tn of the toner transport path 61. In addition, in a case where the old toner Tc is sufficiently captured on the peripheral surface of the supply roller 42, the new toner Tn is not replenished from the toner transport path 61, and in a case where the old toner Tc captured on the peripheral surface of the supply roller 42 is not sufficient, the new toner Tn staying at the toner transport path 61 is replenished to a location in which the old toner Tc is not captured in the peripheral surface of the supply roller 42.

In addition, in the present exemplary embodiment, as shown in FIG. 14B, the partition members 53*a* and 53*b* with the developing chamber side opening 66 of the toner transport path 61 interposed therebetween are respectively provided with the restriction surfaces 70 for restricting an amount of toner captured in the supply roller 42, and thus toner captured in the supply roller 42 is transported only to a range restricted by each restriction surface 70, and residual toner exceeding the restriction surface 70 is excluded.

For this reason, in this example, the old toner Tc which is attached to the supply roller 42 by the attachment mechanism 90 and is re-transported is amount-restricted by the restriction surface 70 of the upstream side partition member 53*b*, and the amount-restricted old toner Tc moves so as to face the developing chamber side opening 66 of the toner transport path 61 according to the rotation of the supply roller 42 and is amount-restricted by the restriction surface 70 of the downstream side partition member 53*a*.

At this time, even if the residual new toner Tn tries to follow the peripheral surface of the supply roller 42 at the location facing the developing chamber side opening 66, the new toner Tn is excluded by the restriction surface 70.

As described above, in the present exemplary embodiment, if a toner accommodating space in the developing chamber 51 is limited by the partition members 53*a* and 53*b*, and the toner accommodating space is limited so as to substantially correspond to an amount which can be transported by the supply roller 42, a space in which stressed toner is diffused and piled disappears in the developing chamber 51. For this reason, even if the new toner Tn is replenished, as long as the old toner Tc is sufficiently captured around the supply roller 42, the new toner Tn is not replenished. Therefore, the old and new toners are not unnecessarily mixed around the supply roller 42, and there is no concern that electric charge distribution due to the charging blade 45 caused by the unnecessary mixture of the old and new toners is broadened.

Exemplary Embodiment 6

Figure 15:
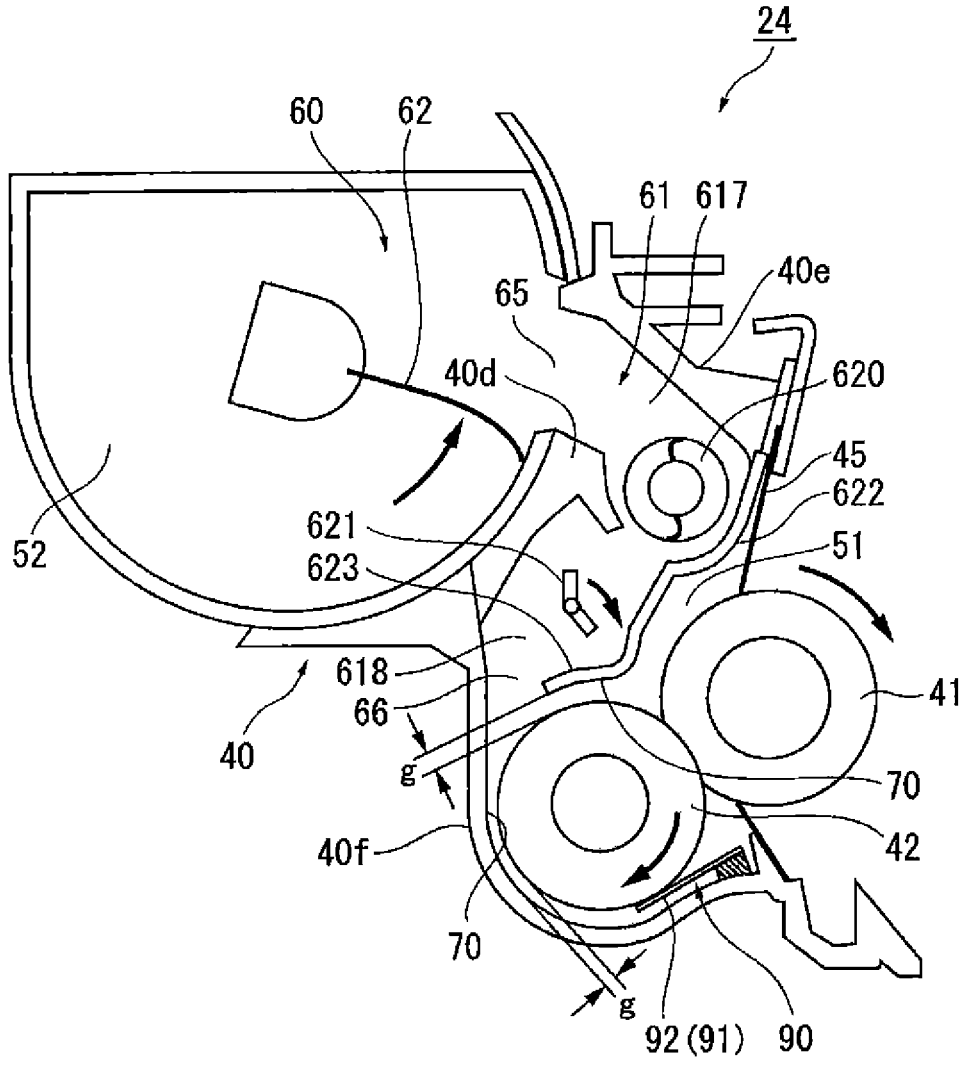
FIG. 15 is a diagram illustrating a main portion of a developing device according to Exemplary Embodiment 6.

FIG. 15 shows a main portion of a developing device according to Exemplary Embodiment 6.

In FIG. 15, a basic configuration of the developing device 24 is substantially the same as in Exemplary Embodiment 5, but a shape of the developing vessel 40, and members forming the toner replenishment mechanism 60 and the restriction surface 70 are different from in Exemplary Embodiment 5.

In addition, the same constituent element as in Exemplary Embodiment 5 is given the same reference numeral as in Exemplary Embodiment 5, and detailed description thereof will be omitted here.

In the present exemplary embodiment, the developing vessel 40 has the developing chamber 51 and the accommodation chamber 52 accommodating new toner, but has a structure in which the new toner is replenished from the substantially vertical direction unlike in Exemplary Embodiment 5.

In addition, the toner replenishment mechanism 60 connects the accommodation chamber 52 and the developing chamber 51 to each other via the toner transport path 61, and the agitator 62 is disposed in the accommodation chamber 52.

In this example, the toner transport path 61 has a first path 617 which extends diagonally downward from the accommodation chamber side opening 65 of the toner transport path 61 and a second path 618 which bends from the first path 617 and extends substantially vertically downward. A transport member (a configuration in which spiral blade members are provided around a rotation shaft in this example) 620 which transports new toner transported from the first path 617 to the second path 618 is disposed at the curved part between the first path 617 and the second path 618, an agitator 621 for stirring is disposed in the middle of the second path 618, and a developing chamber side opening 66 is disposed at the lower part of the second path 618.

Here, in the toner transport path 61, a part of the peripheral wall of the developing vessel 40 is used as path forming portions 40*d* and 40*e*, and a path forming member 622 is installed in the developing vessel 40.

Particularly, in this example, the path forming member 622 is disposed opposite to the path forming portion 40*e* so as to secure the developing chamber side opening 66 between the path forming member 622 and the path forming portion 40*e*. In this example, the developing chamber side opening 66 is formed at a location opposite to the upstream side of the uppermost part of the supply roller 42 in the rotation direction, and a width size of the developing chamber side opening 66 in the rotation direction of the supply roller 42 is set to be smaller than an outer diameter of the supply roller 42 in a projection plane viewed from the supply roller 42 side.

In addition, an opposite wall 623 opposite to the peripheral surface of the supply roller 42 is integrally formed on the downstream side of the developing chamber side opening 66 in the rotation direction of the supply roller 42 in the path forming member 622, and a curved restriction surface 70 which is opposite to the supply roller 42 and is formed along the peripheral surface of the supply roller 42 with the gap g between the opposite wall 623 and the supply roller 42 is provided in the opposite wall 623.

In addition, in this example, a part of the peripheral wall of the developing vessel 40 opposite to the peripheral surface of the supply roller 42 is used as an opposite wall 40*f* on the upstream side of the developing chamber side opening 66 in the rotation direction of the supply roller 42, and a curved restriction surface 70 which is opposite to the supply roller 42 and is formed along the peripheral surface of the supply roller 42 with the gap g between the opposite wall 40*f* and the supply roller 42 is provided in the opposite wall 40*f*.

Here, the gap g may be appropriately selected as long as it is selected to an extent that a toner layer to be captured in the supply roller 42 can be restricted, and, in this example, the gap is selected in a range of 0.5 mm to 1.0 mm.

In addition, the meanings of the lower limit value and the upper limit values are substantially the same as those in Exemplary Embodiment 1.

According to the present exemplary embodiment, the new toner Tn in the accommodation chamber 52 is transported to the toner transport path 61 by the agitator 62, the new toner transported to the first path 617 of the toner transport path 61 is transported to the second path 618 by the transport member 620, and the new toner transported to the second path 618 is transported to the developing chamber side opening 66 by the agitator 621 for stirring. Therefore, also in the example, the toner replenishment mechanism 60 has a structure in which the new toner fills the toner transport path 61 in a staying state.

For this reason, also in the present exemplary embodiment, in the substantially same manner as in Exemplary Embodiment 5, the staying part of the new toner of the toner transport path 61 presses the peripheral surface of the supply roller 42 by its own weight, the interface by the staying part of the new toner of the toner transport path 61 forms a kind of wall, and thus the old toner captured in the supply roller 42 is transported along the peripheral surface of the supply roller 42 without entering the new toner of the toner transport path 61.

In addition, in a case where the old toner is sufficiently captured on the peripheral surface of the supply roller 42, the new toner Tn is not replenished from the toner transport path 61, and in a case where the old toner captured on the peripheral surface of the supply roller 42 is not sufficient, the new toner staying at the toner transport path 61 is replenished to a location in which the old toner is not captured in the peripheral surface of the supply roller 42.

In addition, in the present exemplary embodiment, the opposite wall 623 of the path forming member 622 and the opposite wall 40*f* which is a part of the peripheral wall of the developing vessel 40 with the developing chamber side opening 66 of the toner transport path 61 interposed therebetween are respectively provided with the restriction surfaces 70 for restricting an amount of toner captured in the supply roller 42, and thus toner captured in the supply roller 42 is transported only to a range restricted by each restriction surface 70, and residual toner exceeding the restriction surface 70 is excluded.

For this reason, in this example, the old toner which is attached to the supply roller 42 by the attachment mechanism and is re-transported is amount-restricted by the restriction surface 70 of the opposite wall 40*f* which is a part of the peripheral wall of the developing vessel 40, and the amount-restricted old toner Tc moves so as to face the developing chamber side opening 66 of the toner transport path 61 according to the rotation of the supply roller 42 and is amount-restricted by the restriction surface 70 of the path forming member 622.

At this time, even if the residual new toner Tn tries to follow the peripheral surface of the supply roller 42 at the location facing the developing chamber side opening 66, the new toner Tc is excluded by the restriction surface 70.

As described above, also in the present exemplary embodiment, in the substantially same as in Exemplary Embodiment 5, if a toner accommodating space in the developing chamber 51 is limited by the opposite walls 40*f* and 623, and the toner accommodating space is limited so as to substantially correspond to an amount which can be transported by the supply roller 42, a space in which stressed toner is diffused and piled disappears in the developing chamber 51.

Exemplary Embodiment 7

Figure 16A:
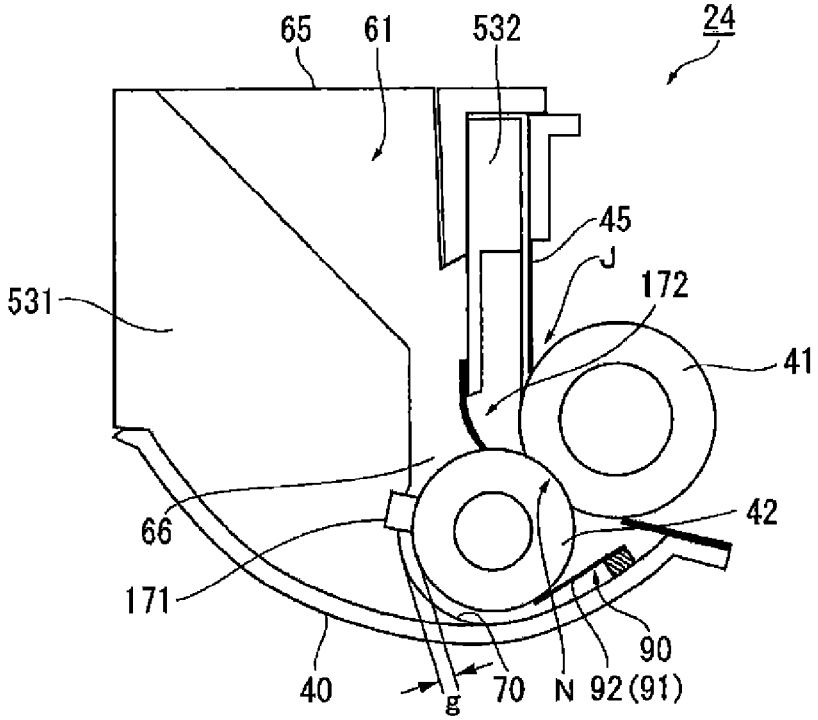
FIG. 16A is a diagram illustrating a main portion of a developing device according to Exemplary Embodiment 7.

FIG. 16A shows a main portion of a developing device according to Exemplary Embodiment 7.

In FIG. 16A, a basic configuration of the developing device 24 is substantially the same as in Exemplary Embodiment 6, but a structure between the toner replenishment mechanism 60 and the supply roller 42 is different from in Exemplary Embodiment 6. In addition, the same constituent element as in Exemplary Embodiment 6 is given the same reference numeral as in Exemplary Embodiment 6, and detailed description thereof will be omitted here.

In FIG. 16A, the toner replenishment mechanism 60 is a mechanism, which has the toner transport path 61 extending in the longitudinal direction along the substantially vertical direction, in which the developing chamber side opening 66 is located on the lower side of the accommodation chamber side opening 65, the developing chamber side opening 66 is disposed opposite to the supply roller 42, new toner in the accommodation chamber (not shown) is transported to the toner transport path 61 by the agitator (not shown), and the toner transport path 61 is filled with the transported new toner in a staying state.

In this example, the developing chamber side opening 66 is disposed so as to face a part located on the upper side of the central position of the supply roller 42 further toward the upstream side in the rotation direction of the supply roller 42 than the vicinity of the uppermost part from the vicinity of the uppermost part of the supply roller 42, and a width size of the developing chamber side opening 66 in the rotation direction of the supply roller 42 is set to be smaller than an outer diameter of the supply roller 42 in a projection plane viewed from the supply roller 42 side.

In addition, the toner transport path 61 is formed so as to be partitioned by a pair of partition members 531 and 532 installed in the developing vessel 40, and a curved restriction surface 70 which is opposite to the supply roller 42 and is formed along the peripheral surface of the supply roller 42 with the gap g between the partition member 531 and the supply roller 42 is provided in one partition member 531.

Here, the gap g may be appropriately selected as long as it is selected to an extent that a toner layer to be captured in the supply roller 42 can be restricted, and, in this example, the gap is selected in a range of 0.5 mm to 1.0 mm. In addition, the meanings of the lower limit value and the upper limit values are substantially the same as those in Exemplary Embodiment 1.

Further, in the present exemplary embodiment, sealing members 171 and 172 which are formed by elastic bodies are provided at an edge part of the developing chamber side opening 66 of the toner transport path 61 in the axis direction of the supply roller 42, and are disposed so as to come into elastic contact with the peripheral surface of the supply roller 42. In this example, the first sealing member 171 located on the upstream side in the rotation direction of the supply roller 42 is a member in which a block body such as elastic rubber comes into pressing contact with the supply roller 42, and the second sealing member 172 located on the downstream side in the rotation direction of the supply roller 42 is formed by, for example, an elastic sheet, and is a member of which one end is fixed to the partition member 532 side and a free end comes into pressing contact with the supply roller 42 in the movement direction of the supply roller 42. However, a contact force of the sealing members 171 and 172 is required to be set to an extent that toner to be captured in the supply roller 42 is not scraped off.

Here, in order to evaluate a performance of the developing device according to the present exemplary embodiment, a developing device of an aspect of not using the sealing members 171 and 172 is used as Comparative Example 7-1 (refer to FIG. 16B), and performances of the two are compared.

Figure 16B:
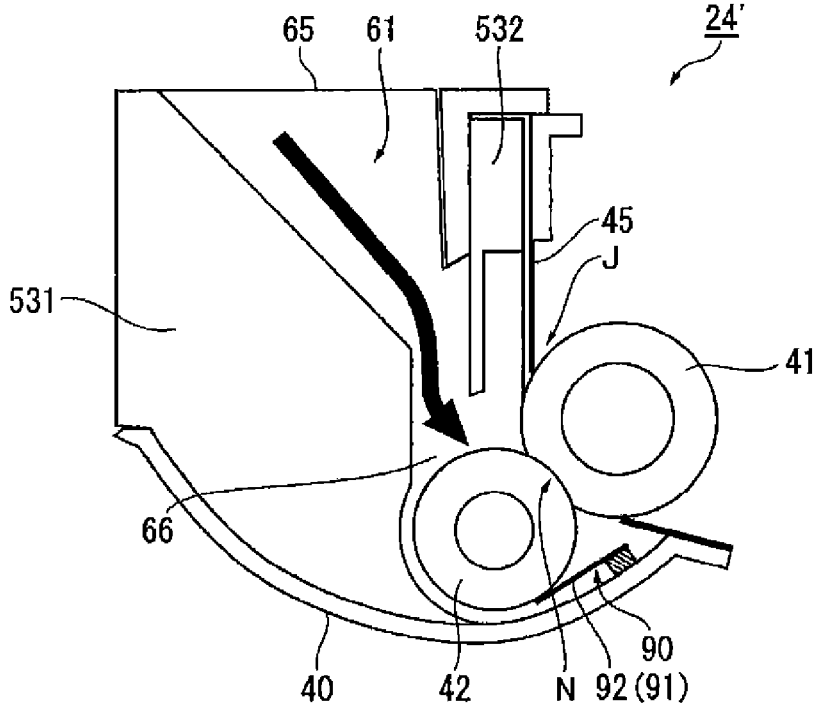
FIG. 16B is a diagram illustrating a main portion of a developing device according to Comparative Example 7.

First, according to a developing device 24' according to Comparative Example 7-1, when new toner is replenished by the toner replenishment mechanism 60 via the toner transport path 61, as indicated by the arrow in FIG. 16B, there is concern that the new toner may be directly replenished from the developing chamber side opening 66 to the contact region N between the developing roller 41 and the supply roller 42, and, further, to a contact region J between the developing roller 41 and the charging blade 45.

Since these contact regions N and J are locations where toners are exchanged, and flow activity of the toners is high, in Comparative Example 7-1, a situation in which the new toner and the old toner are mixed is quickened, and thus a toner fogging phenomenon due to the mixture of the old and new toners with different electrification characteristics easily occurs.

In addition, although the gap g is between the partition member 531 and the supply roller 42, when the new toner is replenished from the gravity direction, the new toner easily directly enters the gap g, and, accordingly, there is concern that the old toner captured in the supply roller 42 may be easily mixed with the new toner.

In contrast, in the present exemplary embodiment, since the sealing member 171 blocks the gap g between the partition member 531 and the supply roller 42, even if the new toner is replenished from the gravity direction, there is no concern that the new toner directly enters the gap g.

In addition, since the sealing member 172 takes up a gap between the partition member 532 on the downstream side of the developing chamber side opening 66 in the rotation direction of the supply roller 42 and the supply roller 42, there is no concern that the new toner is directly replenished to the contact region N between the developing roller 41 and the supply roller 42, or to the contact region J between the developing roller 41 and the charging blade 45 from the developing chamber side opening 66, and a situation in which the new toner and the old toner are unnecessarily mixed is prevented.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a toner holding member that is rotatably installed opposite to an image holding member which holds a latent image and circularly moves, and holds and transports nonmagnetic mono-component toner to a developing region opposite to the image holding member so as to develop the latent image on the image holding member;

a supply member that has a rough surface capable of capturing toner on a peripheral surface of an elastically deformable elastic body, comes into elastic contact with the toner holding member so as to be rotatably installed, and supplies toner to the toner holding member in a contact region with the toner holding member;

a toner supply portion that faces a replenishment region at a location separate from the contact region with the toner holding member in the supply member and supplies new toner; and a restriction member that is installed further toward a downstream side in a rotation direction than the contact region with the supply member and further toward an upstream side in the rotation direction than the developing region of the toner holding member, friction-charges toner held in the toner holding member, and restricts an amount of toner used for development, wherein the toner supply portion connects an accommodation chamber which accommodates new toner so as to be replenished to a developing chamber in which the supply member and the toner holding member are disposed, via a toner transport path, wherein a developing chamber side opening of the toner transport path is located below an accommodation chamber side opening of the toner transport path and is disposed so as to face the supply member, and wherein a width size in a direction following a rotation direction of the supply member in the developing chamber side opening of the toner transport path is set to be smaller than an outer diameter of the supply member in a projection plane viewed from the supply member side.

2. The developing device according to claim 1, wherein the developing chamber side opening of the toner transport path is disposed further toward the downstream side in the rotation direction of the supply member than a lowest part position of the supply member and further toward the upstream side in the rotation direction of the supply member than an uppermost part position of the supply member.

3. The developing device according to claim 2, wherein the toner transport path is partitioned from the accommodation chamber by a first partition member and is partitioned from the developing chamber by a second partition member so as to be formed between the first and the second partition members.

4. The developing device according to claim 3, wherein a downstream side opposite member which is opposite to at least the supply member and is located on the downstream side in the rotation direction of the supply member, and wherein the developing chamber side opening of the toner transport path is disposed in a noncontact manner with the supply member via a gap which can restrict a toner layer to be captured on the peripheral surface of the supply member.

5. The developing device according to claim 2, wherein a downstream side opposite member which is opposite to at least the supply member and is located on the downstream side in the rotation direction of the supply member, and wherein the developing chamber side opening of the toner transport path is disposed in a noncontact manner with the supply member via a gap which can restrict a toner layer to be captured on the peripheral surface of the supply member.

6. The developing device according to claim 2, wherein the developing chamber side opening of the toner transport path includes a toner pile portion in which old and new toners are piled with the passage of time during use on a lower edge thereof, and new toner in the toner transport path is dammed up from moving to the developing chamber other than the supply member by the toner pile part.

7. An image forming apparatus comprising:

an image holding member that holds a latent image and circularly moves; and the developing device according to claim 2 that is disposed opposite to the image holding member and develops the latent image on the image holding member.

8. The image forming apparatus according to claim 7, further comprising:

a controller that controls toner consumption in the developing device, wherein the controller includes a calculation unit that calculates a toner amount consumed in a predetermined number of image formations;

a discrimination unit that discriminates whether or not the toner amount calculated by the calculation unit is equal to or more than a predefined threshold value;

an ejection unit that ejects toner in the developing device to the image holding member side by a predetermined amount when the toner amount discriminated by the discrimination unit is smaller than the threshold value; and a cleaning unit that cleans off the toner on the image holding member, ejected from the ejection unit.

9. The developing device according to claim 1, wherein the toner transport path is partitioned from the accommodation chamber by a first partition member and is partitioned from the developing chamber by a second partition member so as to be formed between the first and the second partition members.

10. The developing device according to claim 9, wherein a downstream side opposite member which is opposite to at least the supply member and is located on the downstream side in the rotation direction of the supply member, and wherein the developing chamber side opening of the toner transport path is disposed in a noncontact manner with the supply member via a gap which can restrict a toner layer to be captured on the peripheral surface of the supply member.

11. The developing device according to claim 1, wherein a downstream side opposite member which is opposite to at least the supply member and is located on the downstream side in the rotation direction of the supply member, and wherein the developing chamber side opening of the toner transport path is disposed in a noncontact manner with the supply member via a gap which can restrict a toner layer to be captured on the peripheral surface of the supply member.

12. The developing device according to claim 1, wherein an edge of the developing chamber side opening edge of the toner transport path is disposed so as to be sealed by an elastic body in a contact manner with the peripheral surface of the supply member.

13. The developing device according to claim 12, wherein the developing chamber side opening of the toner transport path is disposed opposite to the peripheral surface of an upper half of the supply member.

14. An image forming apparatus comprising:

an image holding member that holds a latent image and circularly moves; and the developing device according to claim 1 that is disposed opposite to the image holding member and develops the latent image on the image holding member.

15. The image forming apparatus according to claim 14, further comprising:

a controller that controls toner consumption in the developing device, wherein the controller includes a calculation unit that calculates a toner amount consumed in a predetermined number of image formations;

a discrimination unit that discriminates whether or not the toner amount calculated by the calculation unit is equal to or more than a predefined threshold value;

an ejection unit that ejects toner in the developing device to the image holding member side by a predetermined amount when the toner amount discriminated by the discrimination unit is smaller than the threshold value; and a cleaning unit that cleans off the toner on the image holding member, ejected from the ejection unit.

16. The developing device according to claim 1, wherein an upper end of the developing chamber side opening is disposed below a rotation center of the supply member.

* * * * *